US011788295B2

(12) United States Patent
Van Schalkwyk et al.

(10) Patent No.: US 11,788,295 B2
(45) Date of Patent: Oct. 17, 2023

(54) RAIN GUTTER ASSEMBLY

(71) Applicant: Johannes Cornelius Van Schalkwyk, Nelspruit (CA)

(72) Inventors: Johannes Cornelius Van Schalkwyk, Nelspruit (CA); Terence Maurice White, Nelspruit (CA)

(73) Assignee: Johannes Cornelius Van Schalkwyk, Nelspruit (ZA)

( * ) Notice: Subject to any disclaimer, the term of this patent is extended or adjusted under 35 U.S.C. 154(b) by 275 days.

(21) Appl. No.: 17/297,331

(22) PCT Filed: Sep. 12, 2019

(86) PCT No.: PCT/IB2019/057705

§ 371 (c)(1),
(2) Date: May 26, 2021

(87) PCT Pub. No.: WO2020/109877

PCT Pub. Date: Jun. 4, 2020

(65) Prior Publication Data

US 2022/0025654 A1 Jan. 27, 2022

(30) Foreign Application Priority Data

Nov. 27, 2018 (ZA) ..... 2018/07998

(51) Int. Cl.
*E04D 13/076* (2006.01)
*E04D 13/064* (2006.01)
*E04D 13/072* (2006.01)

(52) U.S. Cl.
CPC ..... *E04D 13/076* (2013.01); *E04D 13/0643* (2013.01); *E04D 13/0645* (2013.01); *E04D 13/0722* (2013.01)

(58) Field of Classification Search
CPC ..... E04D 13/076; E04D 13/0645; E04D 13/0722; E04D 13/0643
See application file for complete search history.

(56) References Cited

U.S. PATENT DOCUMENTS 4,116,008 A * 9/1978 Ward ..... E04D 13/076 52/12
4,837,987 A * 6/1989 Fender ..... E04D 13/076 52/11
5,146,718 A * 9/1992 Baskett ..... E04D 13/0725 248/48.1

(Continued)

FOREIGN PATENT DOCUMENTS

CA 2626160 A1 9/2009
CA 2714167 A1 2/2021

OTHER PUBLICATIONS

International Search Report and Written Opinion received for PCT Patent Application No. PCT/IB2019/057705, dated Nov. 21, 2019, 8 pages.

*Primary Examiner* — Adriana Figueroa
(74) *Attorney, Agent, or Firm* — MORRISON & FOERSTER LLP

(57) ABSTRACT

The invention relates to a rain gutter assembly including a gutter (10) and a moving arrangement (16). The moving arrangement (16) is configured to move at least part of the gutter (10) between an operative or rain gathering position and an inverted or discharge position.

18 Claims, 31 Drawing Sheets

(56) References Cited

U.S. PATENT DOCUMENTS

| | | | | |
|---|---|---|---|---|
| 5,317,843 | A * | 6/1994 | Sheehan | E04D 13/076<br>248/48.2 |
| 5,526,611 | A * | 6/1996 | Leahy | E04D 13/076<br>52/16 |
| 8,234,819 | B2 * | 8/2012 | Petrov | E04D 13/076<br>52/16 |

* cited by examiner

RAIN GUTTER ASSEMBLY

CROSS REFERENCE TO RELATED APPLICATIONS

This application is a national stage application under 35 U.S.C. § 371 of International Application No. PCT/IB2019/057705, filed internationally on Sep. 12, 2019, which claims the priority benefit of South African Application No. 2018/07998, filed on Nov. 27, 2018.

FIELD OF THE INVENTION

The invention relates, generally, to rain gutters. More specifically, the invention relates to a rain gutter assembly, a rain gutter arrangement, a rain gutter accessory and a rain water collection system.

BACKGROUND OF THE INVENTION

Many buildings are constructed with pitched roofs. The angled nature of such a roof generally prevents the accumulation of water. A rain gutter, or rain trough, can be positioned at the lower extremity of a pitched roof. The purpose of a rain gutter (hereinafter interchangeably referred to as a "gutter" and a "rain gutter") is to catch water which runs off the roof and channel it to a spout, gutter box and/or downpipe from which it can be discharged at a desired location.

In use, a gutter may tend to accumulate matter, such as leaves and dirt, which may obstruct the gutter and render it ineffective for its intended purpose. In addition, the weight of the accumulated matter may cause damage to the gutter, e.g. it may cause the gutter to sag which inhibits proper drainage from the gutter, or depending on the gutter material could cause corrosion. In order to reduce this risk, the gutter must be cleaned regularly. The cleaning and servicing of gutters generally requires an individual to stand on a ladder or to climb onto a roof, which can make these tasks difficult, cumbersome and/or dangerous.

Recent disasters have shown one of the main sources of ignition resulting in houses burning down during forest or bush fires, is air borne combustible debris collecting in the gutters. Air borne burning debris that lands on the roof rolls down into the gutters, or lands directly in the gutter, causing ignition of the combustible debris in the gutter, which quickly transfers to the rafters.

Houses in countries that experience heavy snowfall may also have gutters damaged by snow falling off the roof and ice build-up. The gutter itself may also act to increase the depth to which snow builds up on the roof and hence the weight loading on the roof support structure.

Retrieving toys, such as a ball for example, caught in a gutter may be hazardous to persons attempting to retrieve them as commonly this will involve a person or child climbing a ladder to get onto the roof or to access the object directly.

The present invention aims to address or alleviate the abovementioned problems, at least to some extent.

SUMMARY OF INVENTION

According to one aspect of the invention, there is provided a rain gutter assembly including a gutter and a moving arrangement, the moving arrangement being configured to move at least part of the gutter between an operative or rain gathering position and an inverted or discharge position.

The rain gutter assembly may include an elongate gutter which is generally channel-shaped in transverse cross-section and which has a substantially open top, the moving arrangement being attached or attachable to the gutter and being configured to move the at least part of the gutter between the operative or rain gathering position, in which the top of the gutter faces operatively upwardly, and an inverted or discharge position, in which the gutter is tilted such that the top of the gutter operatively faces at least partially downwardly to permit accumulated matter to be discharged from the gutter.

The gutter may have a square, round or any other desired transverse cross-section At least part of the gutter may be displaceable between the operative or rain gathering position and the inverted or discharge position about a pivot axis.

The rain gutter assembly may include at least one mounting element by which the gutter and the moving arrangement are mounted or mountable to a building or building element.

The mounting element may be in the form of a mounting bracket having a first portion which is mounted or mountable to a building or building element and a second portion which is drivingly connected or connectable. to the moving arrangement.

The building element may be a facia board or a rafter.

The rain gutter assembly may include a plurality of mounting brackets which are spaced apart along the length of the gutter.

The moving arrangement may include a pulley and a primary tilt bracket, the pulley being rotatable about the pivot axis.

The pivot axis may extend generally parallel to the length of the gutter.

The primary tilt bracket may include a first portion which is pivotally attached or attachable to one of the at least one mounting elements and a second portion which is fixedly attached or attachable to the gutter.

The primary tilt bracket may be fixedly secured to the pulley such that angular displacement of the pulley causes the primary tilt bracket and the gutter to pivot about the pivot axis.

The second portion may be configured clip-lockingly to engage with the gutter.

The moving arrangement may further include one or more secondary tilt brackets which are spaced longitudinally along the length of the gutter from the primary tilt bracket.

Each of the one or more secondary tilt brackets may have a first portion which is pivotally attached or attachable to a respective one of the at least one mounting elements and a second portion which is fixedly attached or attachable to the gutter, preferably the base of the gutter or a support bracket which forms part of the gutter. In one embodiment of the invention, the torsional stiffness of the gutter may be such that angular displacement of the pulley will cause the one or more secondary tilt brackets to pivot about the pivot axis along with the primary tilt bracket, and thus the gutter.

If necessary, in order to avoid excessive twisting of the gutter, a drive rod may be arranged so as to connect the primary tilt bracket to the one or more secondary tilt brackets.

Two or more secondary tilt brackets may be provided and are connectable to the primary tilt bracket by the drive rod.

In some embodiments, if required, the drive rod may have a length which is substantially equal to the length of the gutter. In use, the primary tilt bracket and the pulley may be centrally located along the length of the gutter while the secondary tilt brackets are spaced along the remaining length of the gutter, thereby substantially supporting the length of the gutter.

The pulley may be operated by an elongate flexible element such as a cable or rope. The cable or rope may be two-ended, in which case the cable or rope may be secured to an appropriate cleat or hook, in use, to prevent angular displacement of the pulley. Alternatively, the cable or rope may be endless (i.e. a closed loop), in which case the pulley may be driven by a second, tensioner pulley, electric (or other) motor or any other actuator system in use.

The moving arrangement may include an elongate gear rack which is drivingly connected to the second portion of the mounting bracket and a pinion which is drivingly connected to the gear rack for longitudinal displacement of the gear rack and displacement of the second portion between the rain gathering position and the inverted or discharge position.

In the inverted position, the gutter may be pivoted through between 0 and 200 degrees about the pivot axis, relative to the rain gathering position.

Ends of the gutter may be closed. One or more drain assemblies may be provided along the length of the gutter. Each drain assembly may include a first part which is connected to the gutter, a second part which is connectable to a downpipe and a coupling whereby the first and second parts are pivotally connected to one another to permit drainage of water from the gutter and for pivotal displacement relative to one another when the gutter is displaced between its operative position and its discharge position. In a preferred embodiment, the first and second parts are pivotally displaceable about the pivot axis.

In accordance with another aspect of the invention, there is provided a rain gutter assembly which includes a gutter having an open top and a mounting arrangement whereby the gutter is mounted or mountable to a building or building unit, the mounting arrangement being configured such that at least part of the gutter is displaceable between an operative position in which the top of the gutter faces upwardly and a discharge position in which the top of the gutter faces downwardly to permit matter which has accumulated in the gutter to be discharged through the top.

According to another aspect of the invention, there is provided a rain gutter arrangement including a plurality of rain gutter assemblies as described above which are independently movable between their rain gathering and inverted positions and which are mounted to a building or building element/s in an end-to-end manner.

In some embodiments, end regions of adjacent gutters of the rain gutter assemblies may overlap in the lengthwise dimension.

According to a further aspect of the invention, there is provided a rain gutter accessory including a moving arrangement substantially as described above which is attached or attachable to an elongate gutter which has a substantially open top, the moving arrangement being configured to move at least part of the gutter between an operative or rain gathering position, in which the top of the gutter faces operatively upwardly, and an inverted or discharge position, in which the gutter is tilted such that the top of the gutter operatively faces at least partially downwardly.

The rain gutter accessory may include at least one mounting element substantially as described above.

According to yet another aspect of the invention there is provided a drain assembly for a drain gutter which includes a gutter which is displaceable between an operative position and a discharge position, the drain assembly including a first part which is connected or connectable in flow communication with the gutter, a second part which is connected or connectable to a downpipe and a coupling whereby the first and second parts are pivotably connected to one another for pivotal displacement relative to one another when the gutter is displaced between its operative position and its discharge position.

The first part may be configured to receive an end portion of at least one gutter therein.

The first part may be generally channel-shaped such that end portions of adjacent gutters are receivable therein.

The first part may include a first elbow and the second part includes a second elbow, the first and second elbows being rotationally interconnected to form the coupling.

According to yet another aspect of the invention, there is provided a rain gutter assembly which includes a gutter and a connecting arrangement whereby the gutter is connectable to a support structure, the connecting arrangement including at least one bracket which is mounted or mountable to the support arrangement and a second portion which is angularly displaceable relative to the first portion and which is connected or connectable to the gutter.

The second portion may be clip-lockingly attachable to the gutter.

BRIEF DESCRIPTION OF THE DRAWINGS

The invention will now be further described, by way of example, with reference to the accompanying conceptual drawings.

In the drawings.

DETAILED DESCRIPTION OF AN EXAMPLE EMBODIMENT

Figure 1:
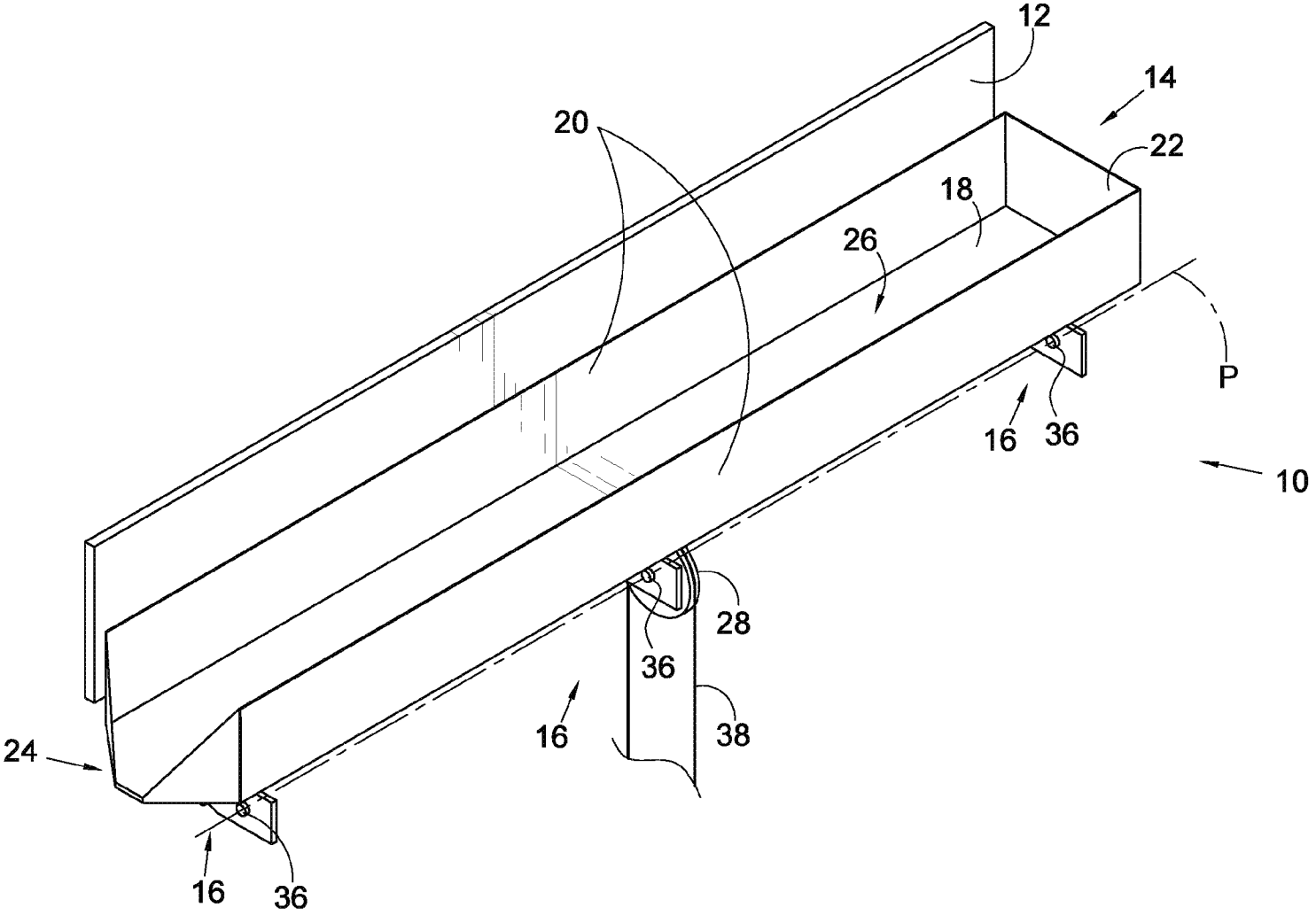
FIG. 1 shows a three-dimensional view of an embodiment of a gutter assembly according to the invention, wherein the gutter assembly is in an operative or rain gathering position.

The following description of the invention is provided as an enabling teaching of the invention. Those skilled in the relevant art will recognise that many changes can be made to the embodiment described, while still attaining the beneficial results of the present invention. It will also be apparent that some of the desired benefits of the present invention can be attained by selecting some of the features of the present invention without utilising other features. Accordingly, those skilled in the art will recognise that modifications and adaptations to the present invention are possible and can even be desirable in certain circumstances, and are a part of the present invention. Thus, the following description is provided as illustrative of the principles of the present invention and not a limitation thereof.

An embodiment of a rain gutter assembly 10 is conceptually illustrated in FIGS. 1 to 8. The rain gutter assembly 10 includes an elongate gutter 14, a moving arrangement 16 and three mounting brackets 17. FIGS. 1 to 8 also illustrate a building unit in the form of an elongate fascia board 12 to which the rain gutter assembly 10 is mounted.

Figure 2:
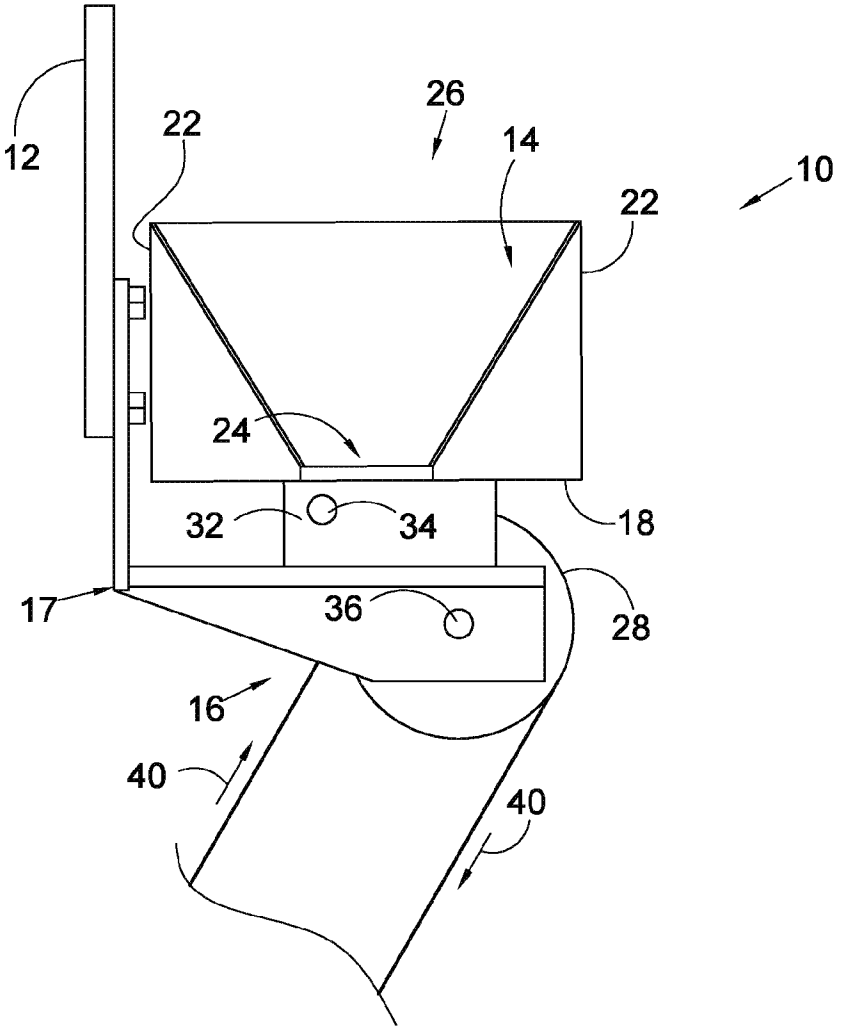
FIG. 2 shows an end view of the gutter assembly of FIG. 1 in the rain gathering position.
Figure 3:
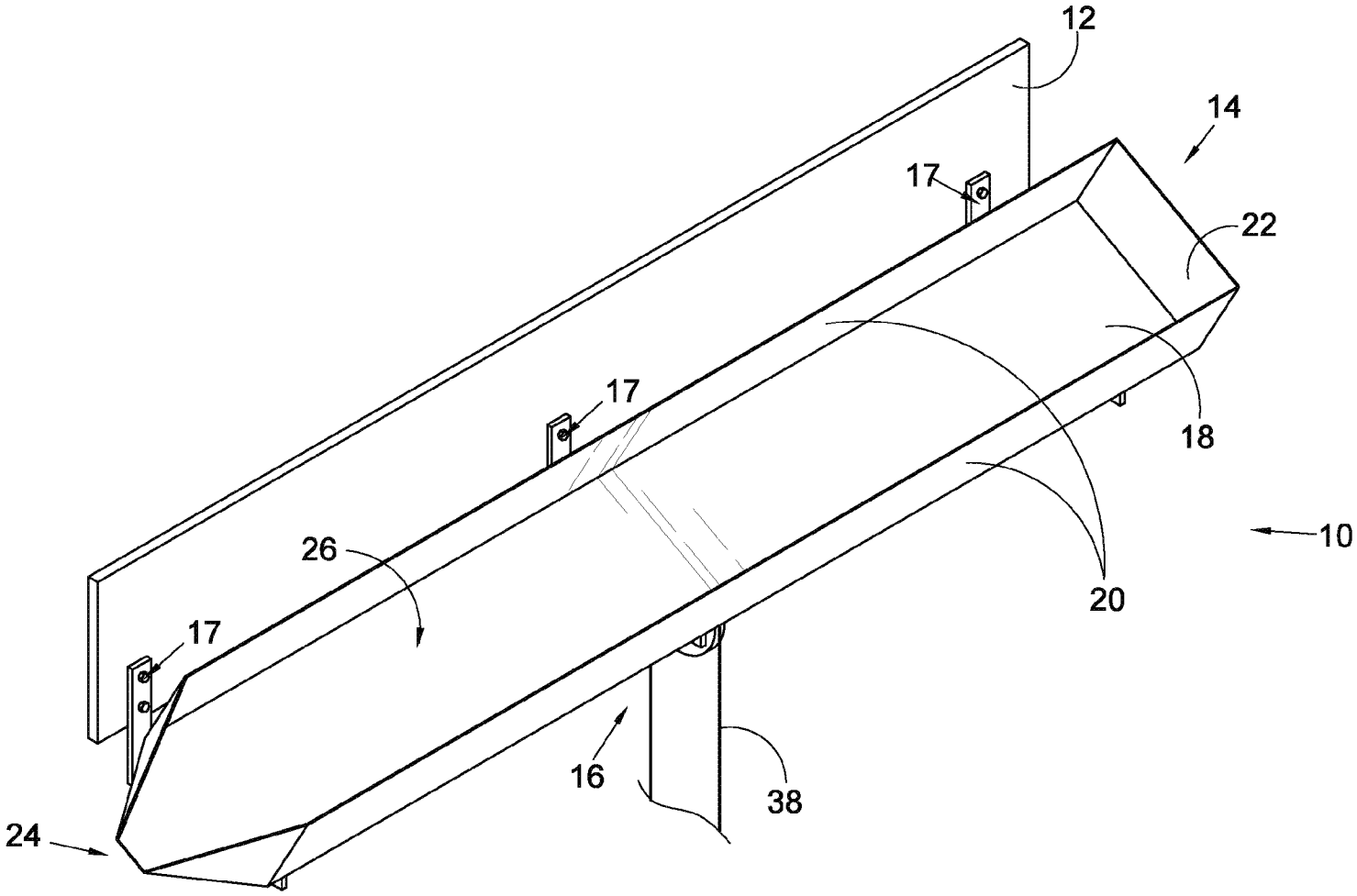
FIG. 3 shows a three-dimensional view of the gutter assembly of FIG. 1, wherein the gutter assembly is in a first intermediate position.
Figure 4:
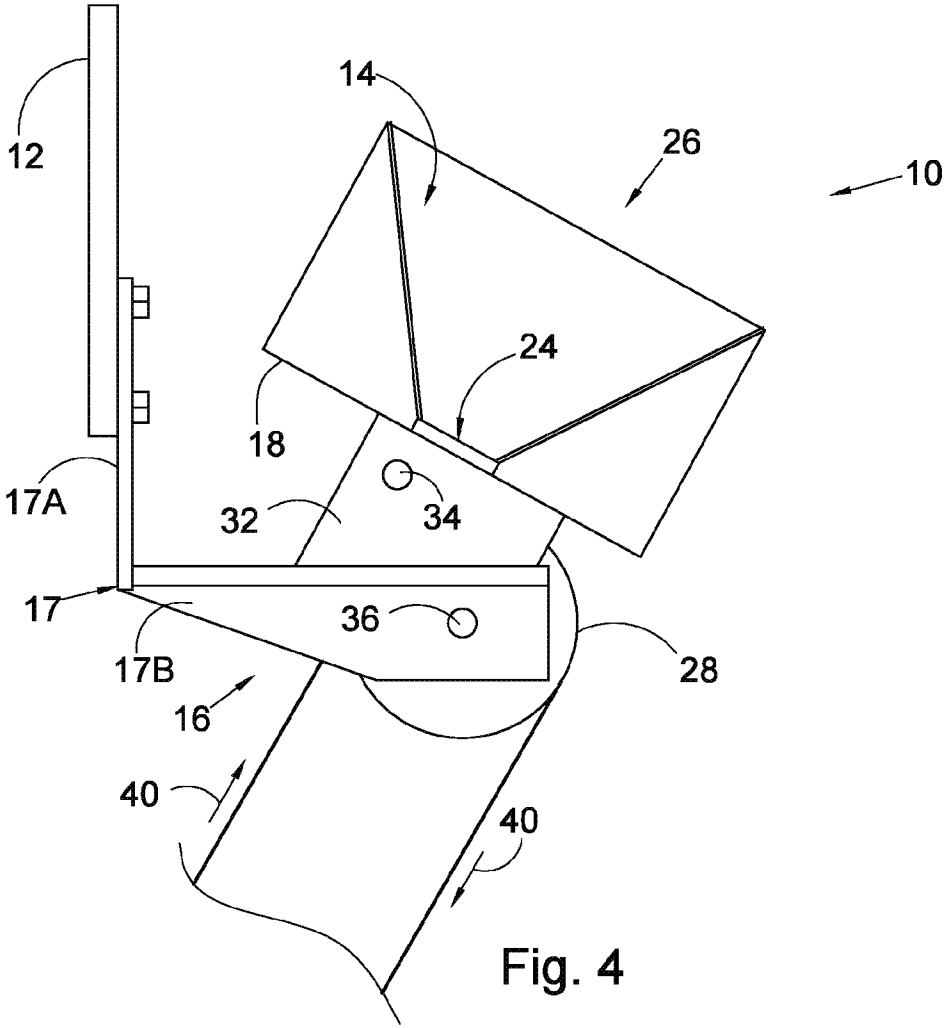
FIG. 4 shows an end view of the gutter assembly of FIG. 1 in the first intermediate position.
Figure 5:
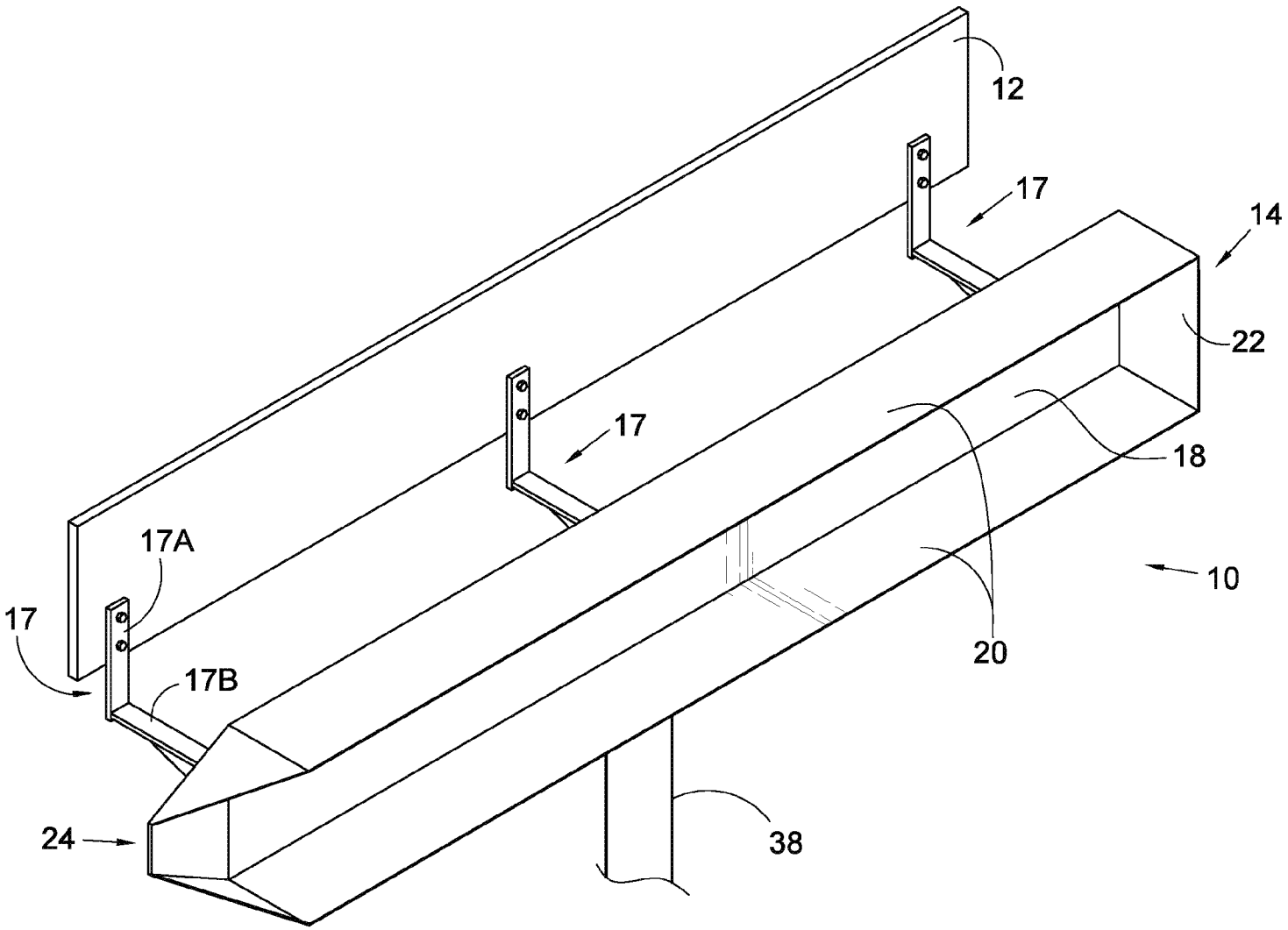
FIG. 5 shows a three-dimensional view of the gutter assembly of FIG. 1, wherein the gutter assembly is in a second intermediate position.
Figure 6:
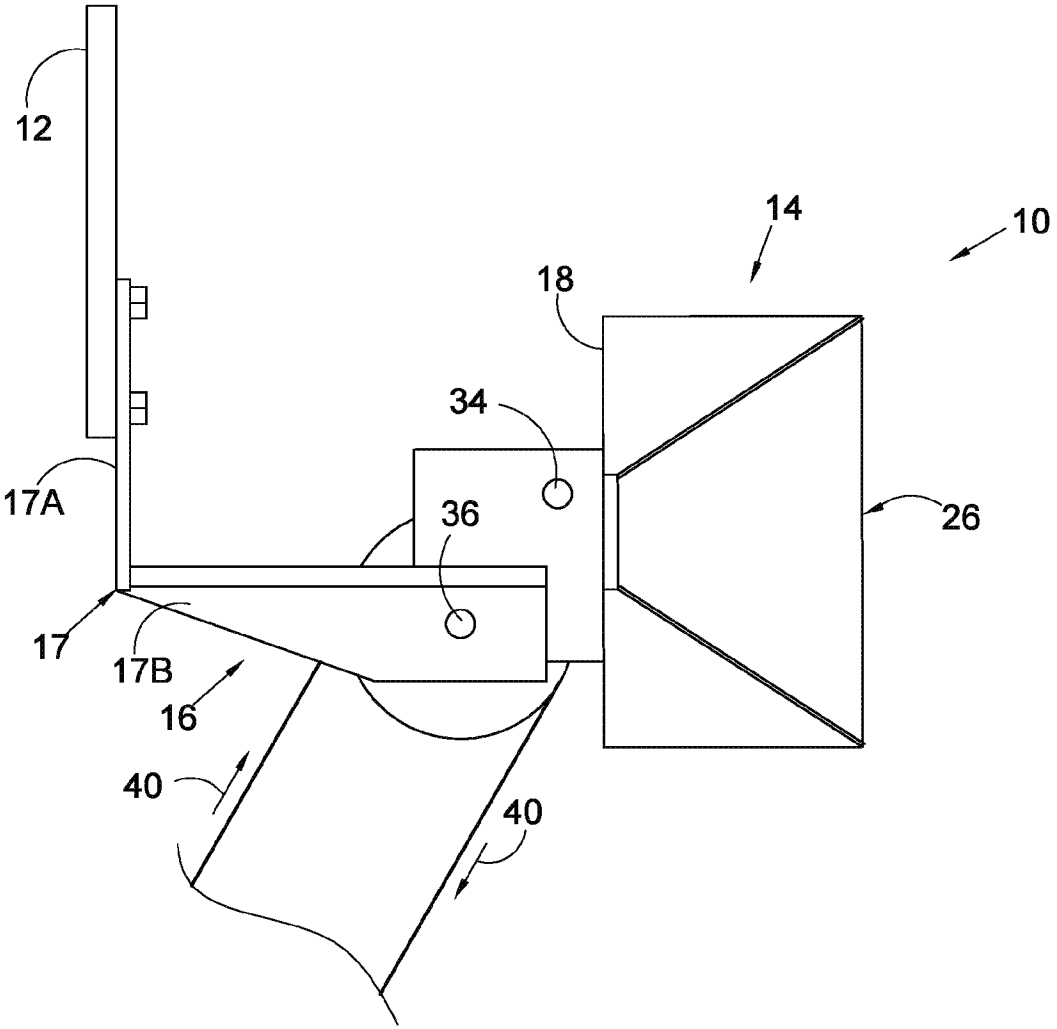
FIG. 6 shows an end view of the gutter assembly of FIG. 1 in the second intermediate position.

The gutter 14 includes a flat base 18, a pair of parallel sidewalls 20 extending along the length of the gutter 14, a closed end 22, and an open end which is defined by a drain spout 24. The gutter 14 has an open top 26 and a channel-shaped transverse cross-section and is configured to receive water (e.g. rainwater) from a roof through the top 26 in an operative or rain gathering position, which is shown in FIGS. 1 and 2. Water exits the gutter 14 via the spout 24, in use. It will be appreciated, however, that the transverse cross-section of the gutter may vary. Accordingly, the sidewalls may not necessarily be perpendicular to the base and the gutter could have a curved or any other suitable transverse cross-section.

The gutter 14 and the moving arrangement 16 are mounted to the fascia board 12 by the mounting brackets 17, which are spaced apart along the length of the fascia board 12. Each mounting bracket 17 has an operative vertical portion 17A which is bolted to a face of the fascia board 12 and an operative horizontal portion 17B which extends away from the fascia board 12.

The moving arrangement 16 includes a pulley 28, a primary tilt bracket 30 (FIG. 7), two secondary tilt brackets 32 which are connected to the gutter 14 and a drive rod 34. The primary tilt bracket 30 is centrally located along the length of the gutter 14, while the two secondary tilt brackets 32 are located at opposite end regions of the gutter 14.

Each of the tilt brackets 30, 32 is pivotably secured to a horizontal portion 17B of a corresponding one of the mounting brackets 17. Each tilt bracket 30, 32 and its corresponding mounting bracket 17 are secured in a side-by-side manner by way of a pivot pin 36.

The pulley 28 is fixedly secured to the primary tilt bracket 30 in a side-by-side manner and is also mounted to the pivot pin 36 to which the primary tilt bracket 30 is secured. The pulley 28 is thus also pivotably mounted to one of the mounting brackets 17 and angular displacement of the pulley 28 causes angular displacement of the primary tilt bracket 30.

Figure 7:
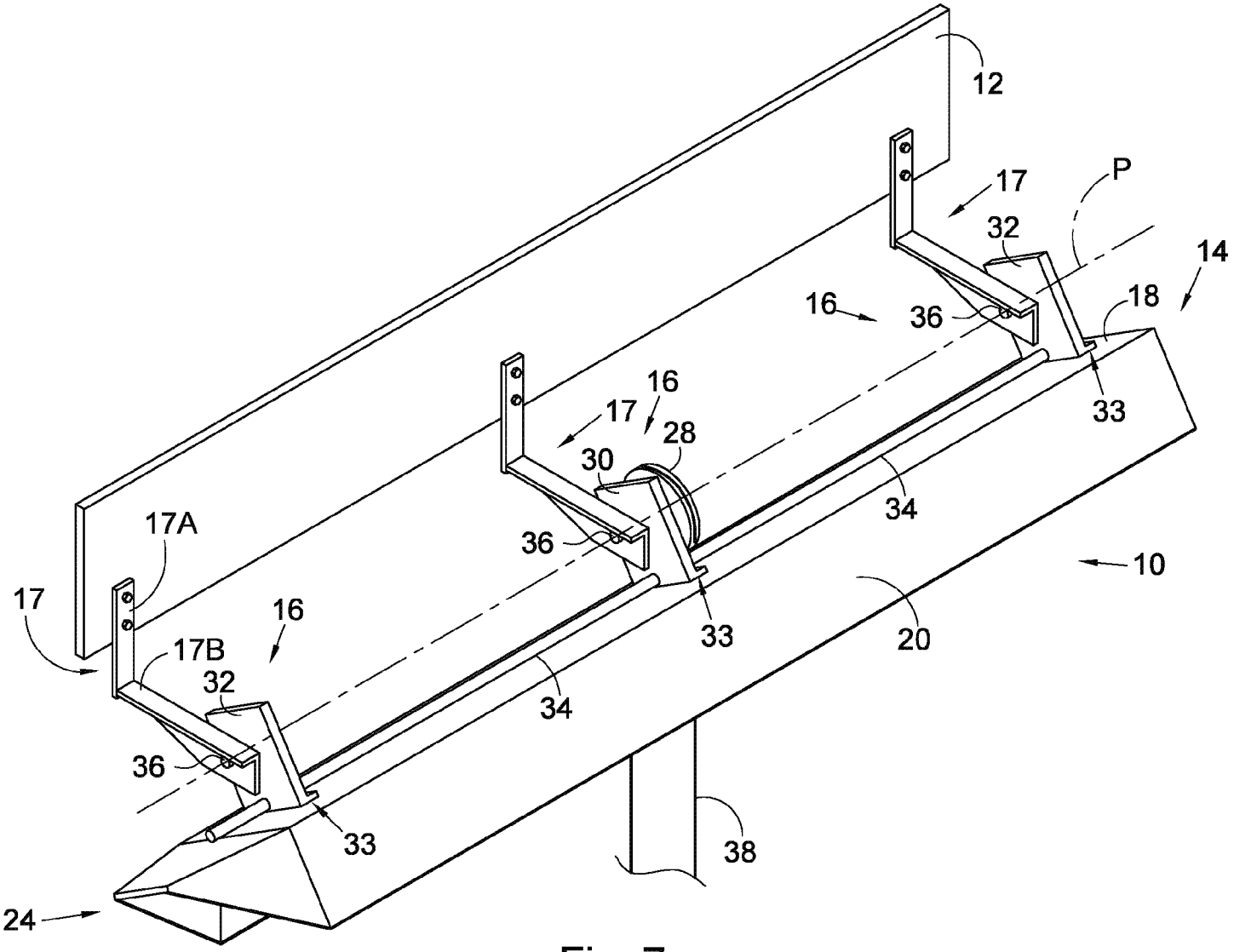
FIG. 7 shows a three-dimensional view of the gutter assembly of FIG. 1, wherein the gutter assembly is in a discharge or inverted position.

The pulley 28 and pivot pins 36 define a pivot axis "P" about which the pulley is pivotable and which extends parallel to the length of the gutter 14. The pivot pins 36 are vertically and horizontally aligned and the pivot axis P thus extends through all three of the pivot pins 36. The pivot axis P is shown in FIGS. 1 and 7.

The drive rod 34 is secured to and extends through each one of the tilt brackets 30, 32, parallel to the length of the gutter 14. The drive rod 34 thus connects the primary tilt bracket 30 and the pulley 28 to the two secondary tilt brackets 32. In this way, angular displacement of the pulley 28 causes angular displacement of the primary tilt bracket 30, the drive rod 34 and the secondary tilt brackets 32, while the mounting brackets 17 remain in fixed positions.

Each of the tilt brackets 30, 32 has an L-shaped end region 33 which is fixedly secured to a bottom surface of the base 18 of the gutter 14, thereby supporting the gutter 14 along its length. Accordingly, tilting of the tilt brackets 30, 32 causes simultaneous tilting of the gutter 14. The end regions 33 of the brackets 30, 32 are most clearly shown in FIG. 7.

The pulley 28 is operated by a cable 38. In this embodiment, although not shown, the cable 38 is endless (i.e. a closed loop) and is driven by an electric motor which is operated by a user. It will be appreciated, however, that instead of making use of an electric motor, the cable 38 could be manually displaced.

Figure 8:
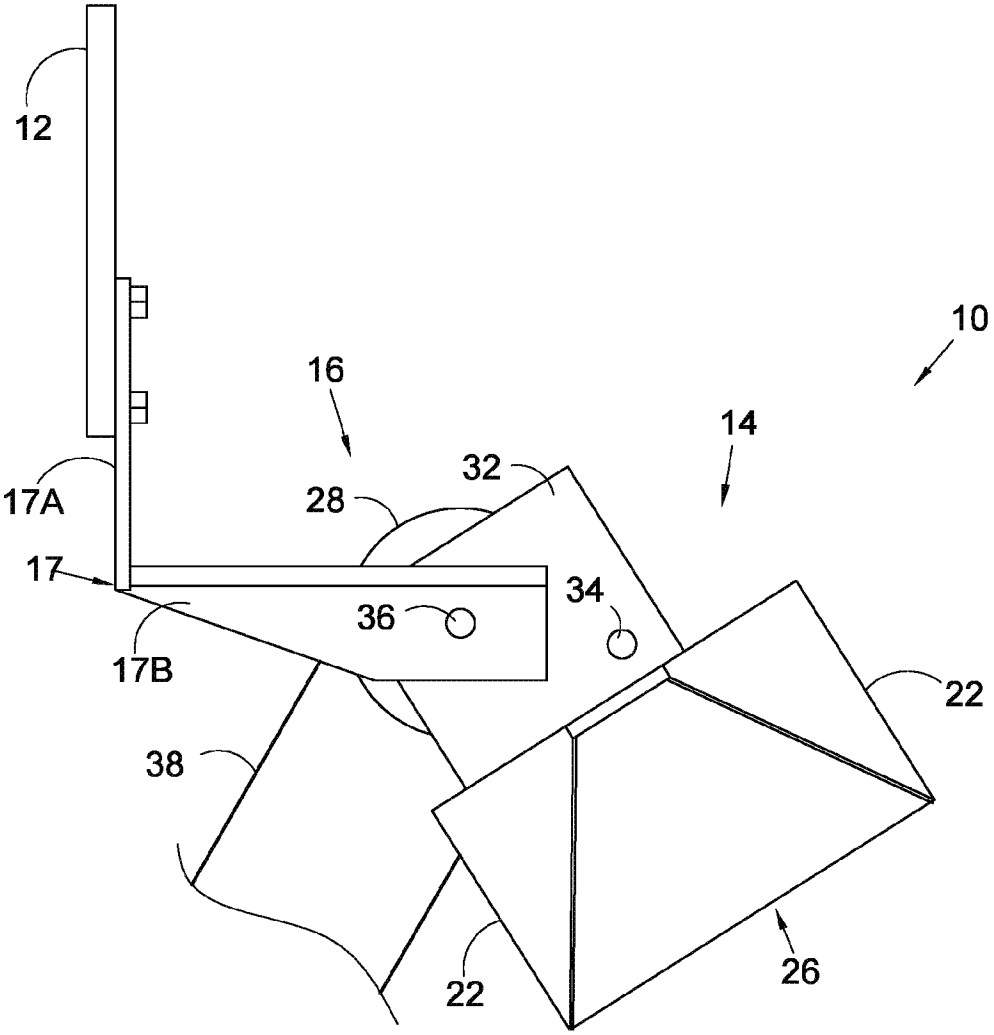
FIG. 8 shows an end view of the gutter assembly of FIG. 1 in the inverted position.

In use, the rain gutter assembly 10 permits the gutter 14 to be pivoted about the pivot axis P, between the rain gathering position shown in FIGS. 1 and 2 and an inverted or discharge position, which is shown in FIGS. 7 and 8.

In the rain gathering position, the top 26 of the gutter 14 faces upwardly and the gutter 14 functions in a normal manner (i.e. catches and diverts run-off water from a roof). When a user wishes to pivot the gutter 14 such that the top 26 of the gutter 14 faces generally downwardly, the cable 38 can be driven by the electric motor as indicated by the directional arrows 40 to tilt the gutter 14 through a series of intermediate positions (two of which are shown in FIGS. 3 to 6 for exemplary purposes) until the top 26 faces sufficiently downwardly, as indicated in FIGS. 7 and 8. In the inverted position, accumulated matter may be discharged from the gutter 14 by operation of gravity. Alternatively or additionally, the user may manually clean the gutter 14 while in the inverted position, e.g. by spraying water into the gutter 14.

The gutter 14 can be pivoted, for instance, 150 degrees or a full 180 degrees from the rain gathering position to assume the inverted position. It will be understood that the cable 38 can be driven in the opposite direction to pivot the gutter 14 back to the rain gathering position when normal operation is to be resumed.

The gutter assembly 10 of FIGS. 1 to 8 may form part of a gutter arrangement, in use. The gutter arrangement may include a plurality of rain gutter assemblies as described above which are independently movable between their rain gathering and inverted positions and which are mounted to a building or building element/s in an end-to-end manner. It is envisaged that at least some of the end regions of adjacent gutters may overlap in the lengthwise direction.

The moving arrangement 16 may be provided as a gutter accessory. The accessory may then be used to retrofit an existing, fixed gutter, thereby to enable it to pivot as described herein. It should be understood that any suitable number of primary and/or secondary tilt brackets may be provided, depending on the gutter specifications. The drive rod may have any suitable length, but it is envisaged that its maximum length should be restricted to 6 m.

Reference is now made to FIGS. 9 to 21 of the drawings, in which reference numeral 50 refers to another rain gutter arrangement in accordance with the invention and, unless otherwise indicated, the same reference numerals used above are used to designate similar parts.

The rain gutter arrangement 50 includes three rain gutter assemblies 52, 54, 56 which are mounted immediately below a lower edge of a roof 58. It will be appreciated, however, that the rain gutter arrangement 50 could include any number of rain gutter assemblies.

Although the lengths of the rain gutter assemblies 52, 54, 56 vary, the structure and mode of operation of each rain gutter assembly is similar and accordingly, for brevity of description, only the rain gutter assembly 52 is described in further detail.

In contrast with the gutter assembly of FIGS. 1 to 8, which makes use of a drain spout 24 at the end of the gutter assembly 10, the gutter assembly 52 includes a down pipe 60 to which the gutter 14 of the gutter assembly 52 is connected by a drain assembly, generally indicated by reference numeral 62. The down pipe 60 may be diverted away from the building, or connected to a pipe network to divert water to a collection tank. The invention accordingly extends to a rainwater collection system which incorporates the collection tank and a pipe network whereby the gutter arrangement is connected thereto.

The gutter 14 of the gutter assembly 52 is of composite construction and comprises two elongate sections 64, 66, each of which is channel-shaped in transverse cross-section. The drain assembly 62 includes a first part 68, a second part 70 and a coupling 72 whereby the first part 68 and second part 70 are pivotally connected together as described in more detail herebelow. The first part 68 includes a channel shaped upper portion 74 having a base or web 76 and a pair of flanges 78 which protrude upwardly from opposite edges of the base 76. A hole (not shown) extends through the base 76 and an elbow 80 is attached to the base 76 and protrudes therefrom in register with the hole in the base.

The second part 70 includes an elbow 82, one end of which is provided with a connecting formation 84 which connects to an upper end of the down pipe 60. The other ends of the elbows 80, 82 are rotationally interconnected to form the coupling 72 which permits the first part 68 and the second part 70 to be angularly displaced relative to one another about a pivot axis which coincides with the axis P. The connecting formation 84 may be configured to connect with a drainpipe 60 of a particular shape or it may be configured for connection with a variety of drainpipes.

End portions of the sections or gutter lengths 64, 66 are received in the upper portion 74 such that the gutter lengths 64, 66 protrude therefrom in opposite directions. An end cap 90 closes off the free end of the gutter length 64 and an end cap 92 closes off the free end of the gutter length 66. The end cap 92 is provided with an inclined surface 94 the purpose of which is described in more detail below. If desired, a compressible seal can be provided between the gutter lengths 64, 66 and the upper portion 74 and between the end caps 90, 92 and the ends of the gutter lengths. Further, if desired, interconnected components of the gutter assembly 52 can be secured together, e.g. adhesively.

The gutter 14 is supported by a pair of brackets 96, 98. The brackets 96, 98 are similar in construction and accordingly only the bracket 96 is described in more detail herebelow. It will be appreciated that for longer gutters more brackets may be used.

Figure 11:
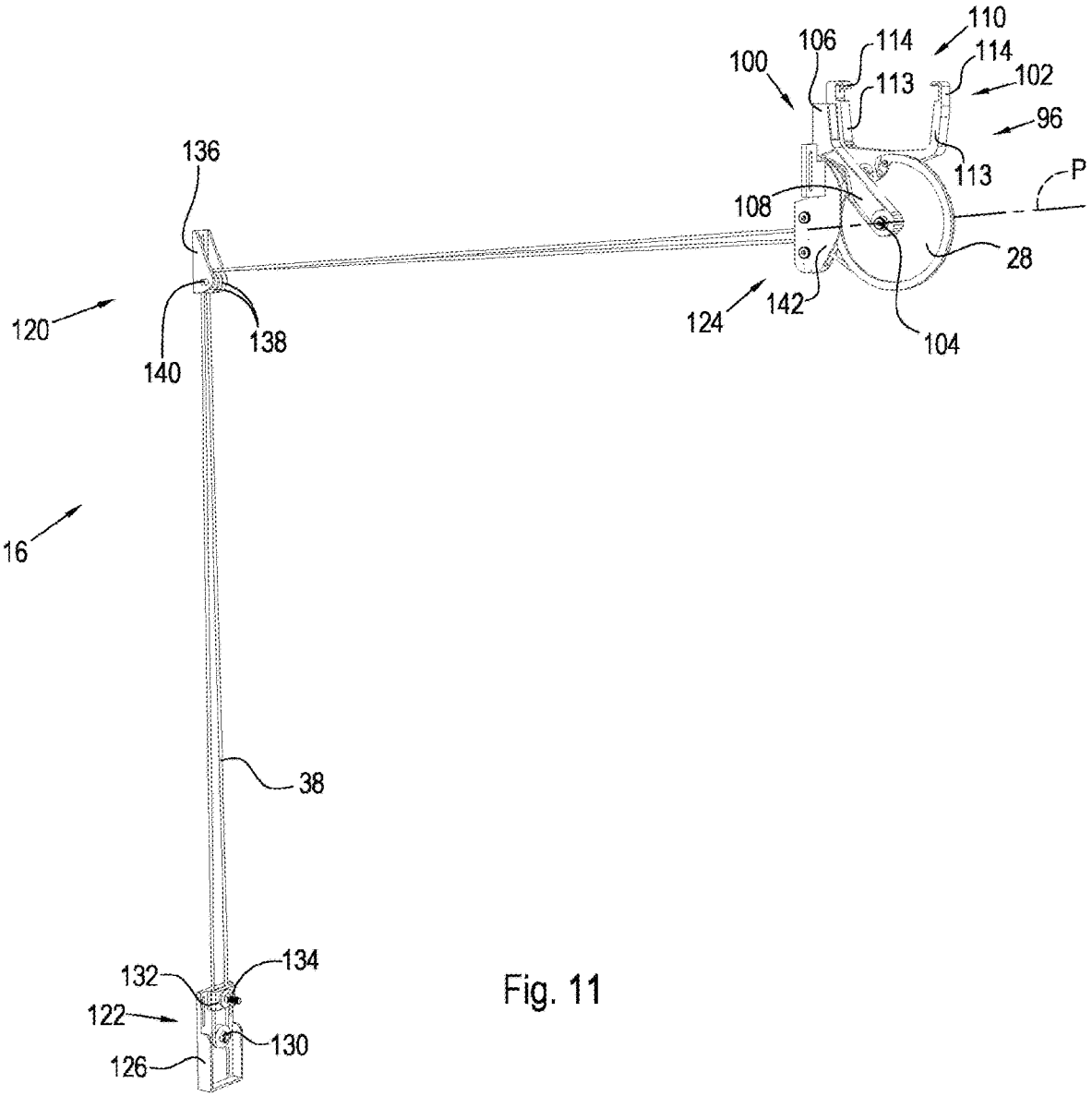
FIG. 11 shows a three-dimensional view of a moving arrangement of the rain gutter assembly of FIG. 10.
Figure 12:
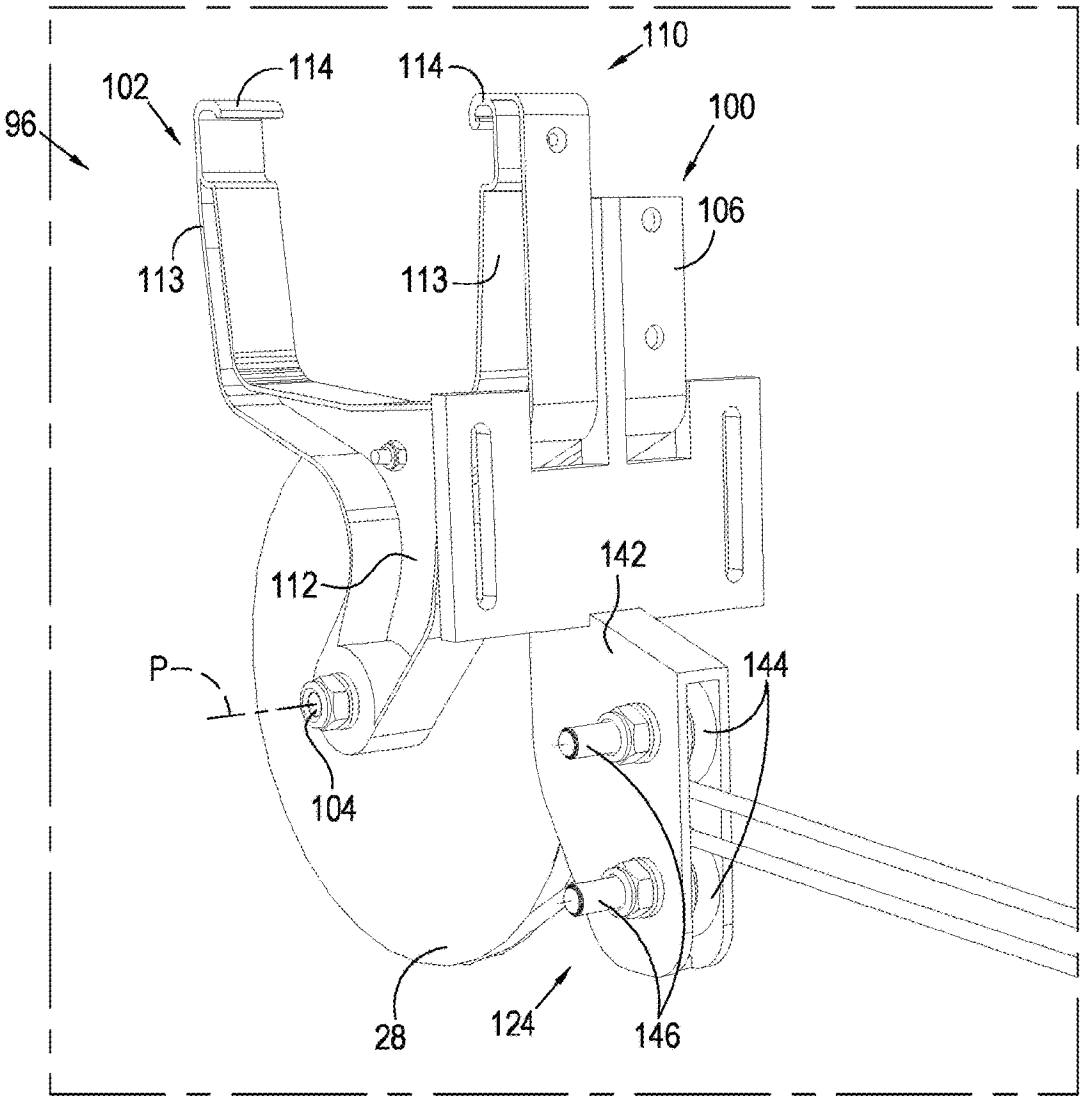
FIG. 12 shows, on an enlarged scale, part of the moving arrangement of FIG. 11.

With particular reference to FIGS. 11 and 12, the bracket 96 includes first and second portions 100, 102 which are pivotally connected together by means of a pivot pin 104. Each of the first portion 100 and second portion 102 is formed as a moulding of a synthetic plastics material (but not exclusively restricted to such material). The first portion 100 includes a base 106 which is secured to the facia 12 by means of screws extending therethrough into screw-threaded engagement with the facia. The first portion 100 further includes a leg 108 which protrudes from an end of the base 106 at an obtuse angle and which defines, at its free end, a sleeve having a hole therethrough within which the pivot pin 104 is received.

The second portion 102 includes a generally channel-shaped gutter engaging formation 110 and a leg 112 which protrudes from the gutter engaging formation 110 and defines a sleeve through which a hole extends within which the pivot pin 104 is receivable in order to connect the first and second portions 100, 102 together and to permit relative pivotal displacement. The gutter engaging formation 110 includes a pair of spaced-apart limbs 113 each of which incorporates a clip 114 towards its free end which is configured, snap-lockingly to engage with a complementary rib 116 provided on the gutter length 66. In this regard, the gutter lengths will typically be extruded from a synthetics plastics material and accordingly can be manufactured to any suitable length. In addition, the dimensions of the gutter lengths as well as the material from which they are manufactured will be sufficiently stiff so as to permit tilting of the gutter length in the manner described below. If desired, the gutter lengths can be secured to the brackets 96, 98 by locking screws which inhibit relative longitudinal movement of the gutter relative to the brackets.

The moving arrangement 16 is similar to that described above and the pulley 28 is fixed to the second portion 102 of the bracket 96 for rotation about the axis P. The rope 38 is an endless rope. The drive or moving arrangement 16 further includes a wall pulley assembly, generally indicated by reference numeral 120, an end pulley clamp assembly, generally indicated by reference numeral 122 and a guide pulley assembly, generally indicated by reference numeral 124.

As can best be seen in FIG. 11 of the drawings, the end pulley clamp assembly 122 includes a bracket 126 which is mounted on the wall 128 of a structure to which the gutter is attached.

The end pulley clamp assembly 122 further includes a return pulley 130 about which the cable 38 extends. Accordingly, the cable is a closed loop which extends around the pulleys 28 and 130. A clamp plate 132 is mounted to the bracket 126 by means of a threaded shank and lock nut 134. By tightening the lock nut 134, the plate 132 can be urged towards the bracket such that the rope 38 is sandwiched therebetween and effectively locked in position.

The wall pulley assembly 120 includes a bracket 136 which is mounted to the wall 128 at an elevation above that of the bracket 126 and more or less in line with the pulley 28. The bracket 136 is generally U-shaped in transverse cross-section and a pair of idler pulleys 138 are rotatably mounted side-by-side on a shaft 140. Two lengths of the rope 138 extend around the pulleys 138.

The guide pulley assembly 124 includes a bracket 142 which is mounted to the facia board 12. A pair of spaced-apart guide pulleys 144 are mounted to the bracket 142 by shafts 146 for rotation about parallel spaced-apart axes. The lengths of the rope 38 extend between and the guide pulleys 144 and over the pulley 28 so as to maximise the length of the perimeter of the pulley 28 with which the rope is in contact thereby permitting maximum torque to be applied to the pulley 28 and to ensure alignment of the lengths of the rope with a peripheral recess in the pulley 28.

In use, when the gutter assembly 52 is in its normal operative position (shown in FIGS. 9 and 10 of the drawings), the lock nut 134 will be screwed in, in order to urge the plate 132 towards the bracket 126 and effectively inhibit displacement of the rope 38.

Figure 9:
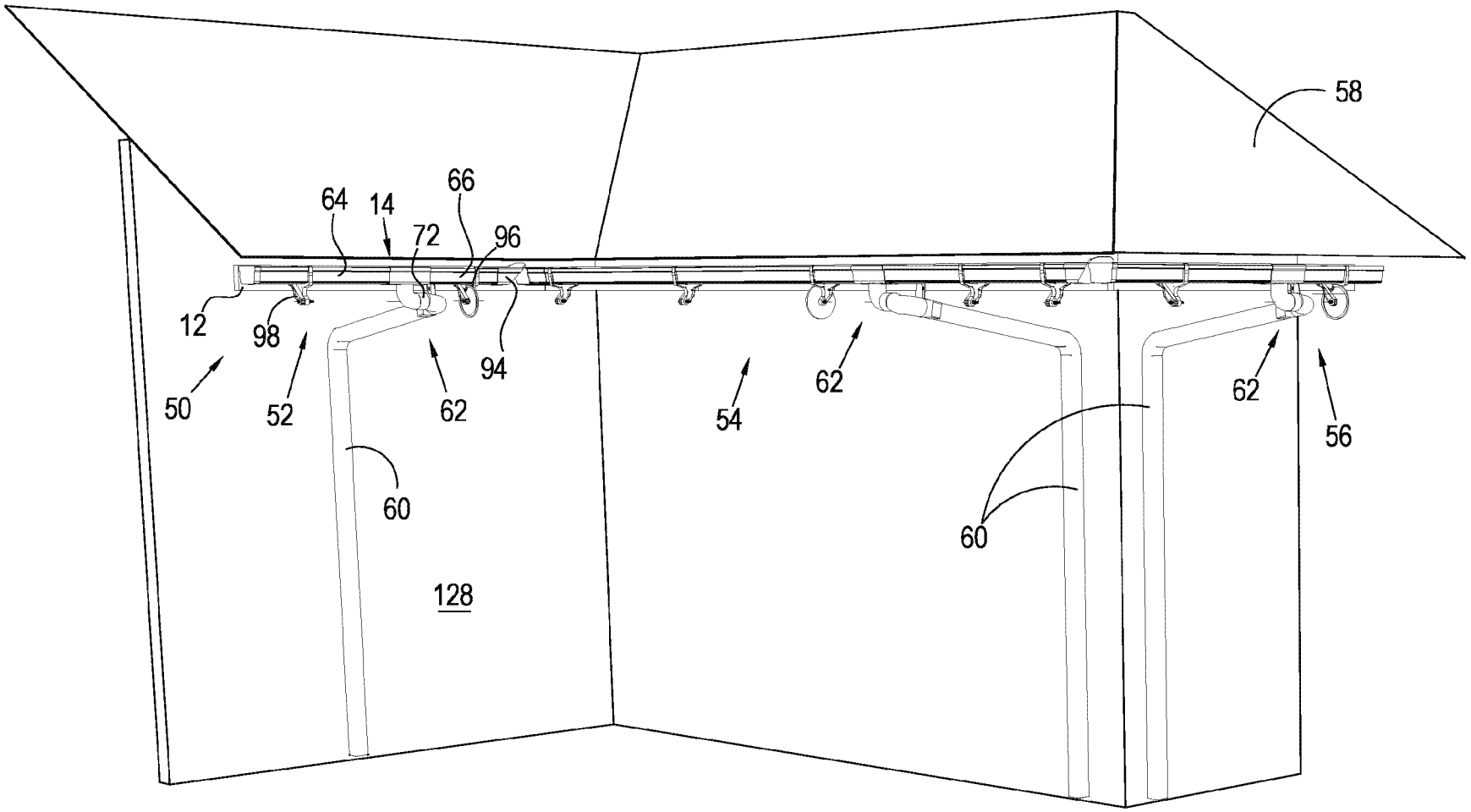
FIG. 9 shows a three-dimensional view of another rain gutter arrangement in accordance with the invention.
Figure 10:
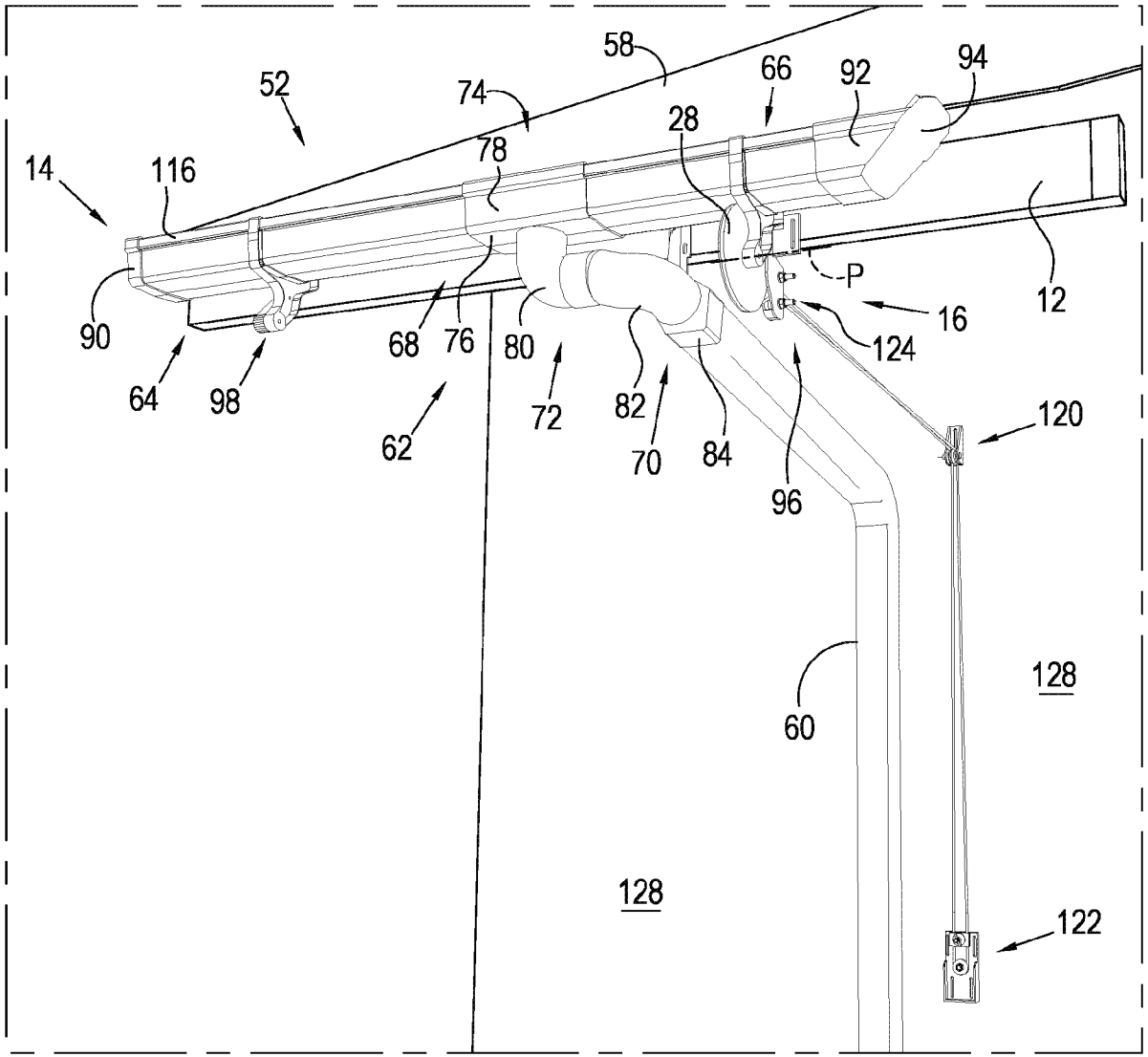
FIG. 10 shows, on an enlarged scale, a three-dimensional view of one of the rain gutter assemblies of the rain gutter arrangement of FIG. 9.

With particular reference to FIG. 9 of the drawings, it will be noted that when the gutters are in their normal operative positions, the inclined surface 94 of end cap 92 positioned at the free end of the gutter lengths 66 has an upper edge which protrudes beyond the upper edge of the gutter length 66 and overlaps the adjacent edge of the rain gutter assembly 54. In this way, the upwardly protruding portion of the surface 94 effectively bridges the gap between the gutter assemblies 52, 54 thereby reducing the risk that precipitation will fall between the gutter assemblies 52, 54. It will be appreciated, that a similar configuration can be provided between each pair of adjacent gutter assemblies to reduce the risk of precipitate or water runoff from the roof following falling therebetween. When it is desired to displace the gutter assembly 52 into its discharge position, the lock nut 134 is loosened in order to permit displacement of the rope and thereby rotation of the pulley 28 and the gutter assembly 52 in the manner described above and as illustrated in FIGS. 15 to 20 of the drawings. When it is desired to return the gutter assembly 52 to its operative position, the rope 38 is displaced in the opposite direction and once the gutter assembly is in its operative position, the lock nut 134 is tightened in order to lock the rope and hence the gutter assembly into position.

As can be seen in FIG. 9 of the drawings, in the operative position, the end face 94 of the endcap 92 extends above and over the adjacent gutter assembly 54 such that rain or other precipitation running off the roof of the structure does not fall between the gutter assemblies 52, 54.

The provision of the coupling 72 permits the first part 68 to pivot about the axis P relative to the second part 70 thereby avoiding the need for any disconnection between the components of the gutter assembly.

Figure 13:
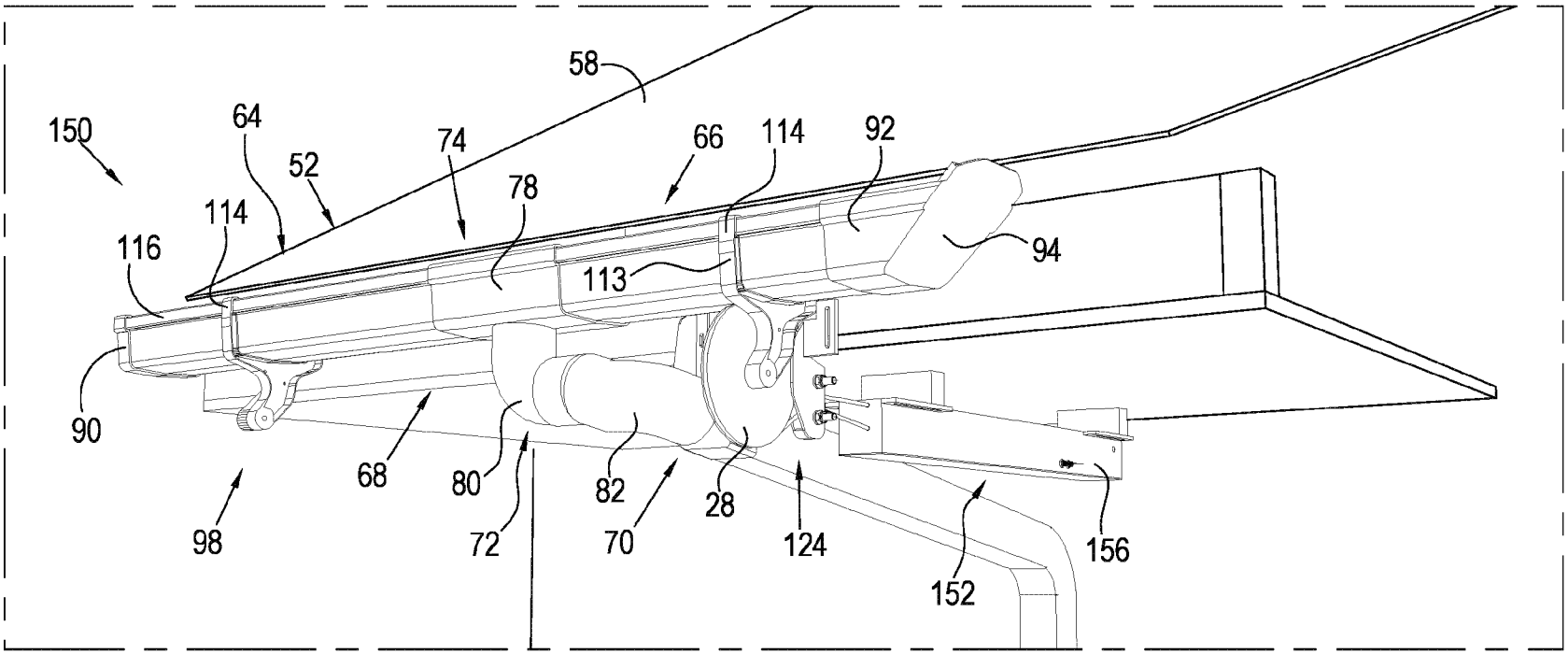
FIG. 13 shows a three-dimensional view, similar to FIG. 10 of a rain gutter assembly making use of a pneumatic moving arrangement.
Figure 14:
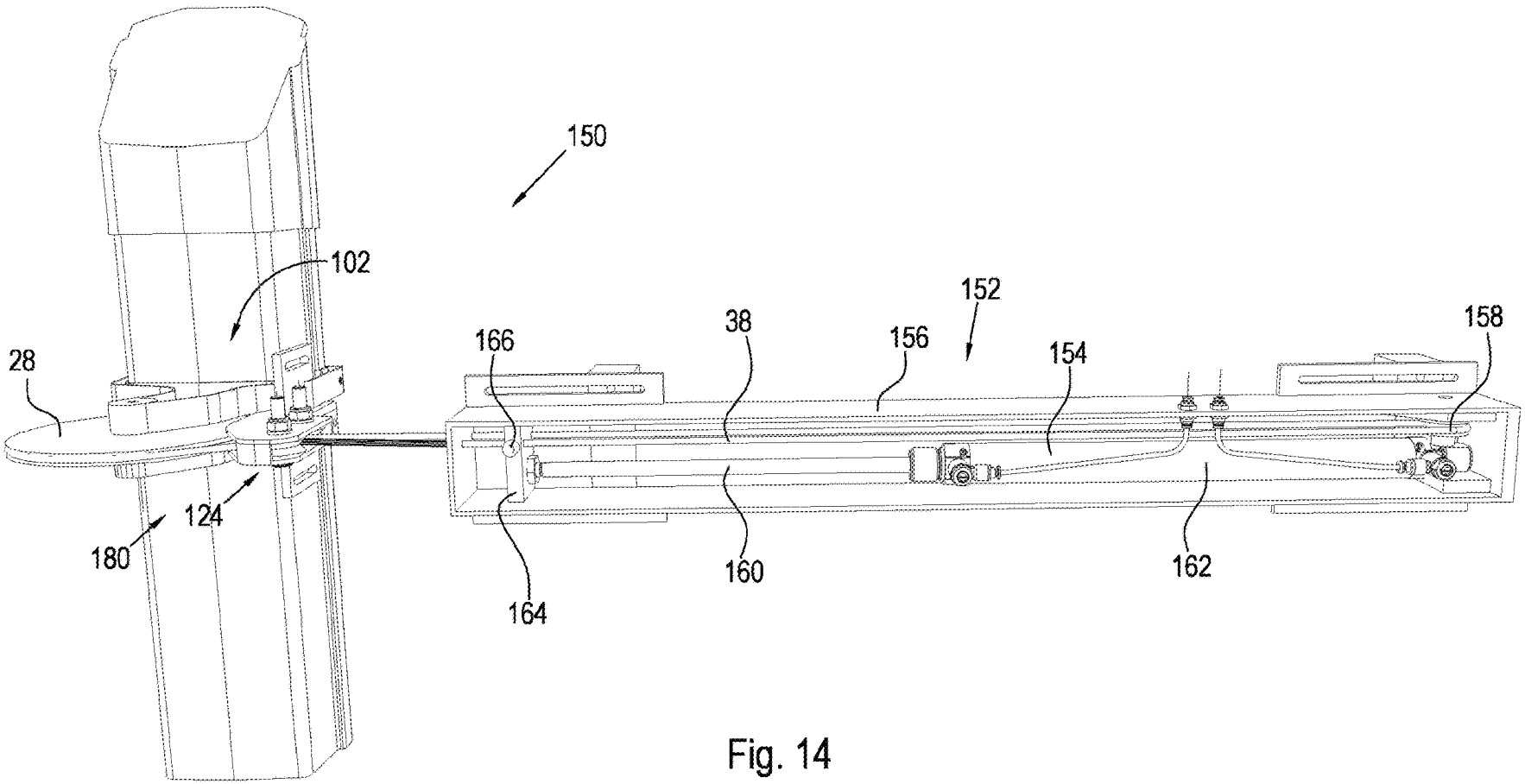
FIG. 14 shows a bottom view of the moving arrangement of FIG. 13 with a cover removed.
Figure 15:
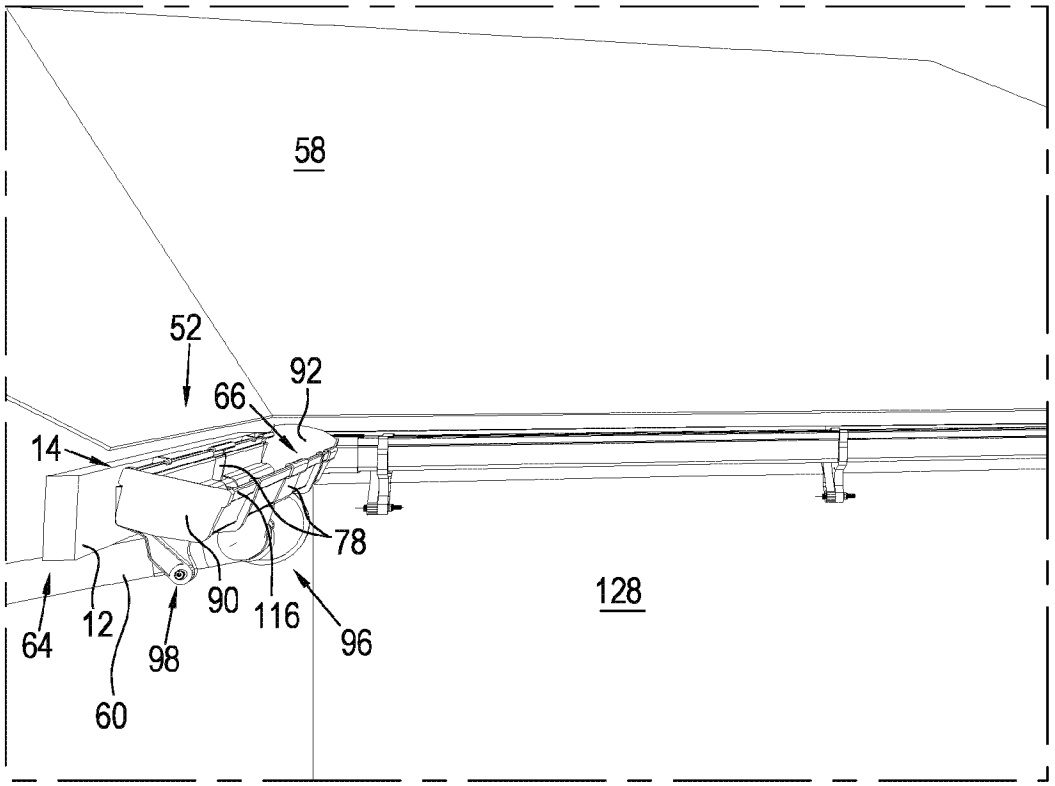
FIG. 15 shows a three-dimensional view of the gutter arrangement displaced away from its rain gathering position through 15°.
Figure 16:
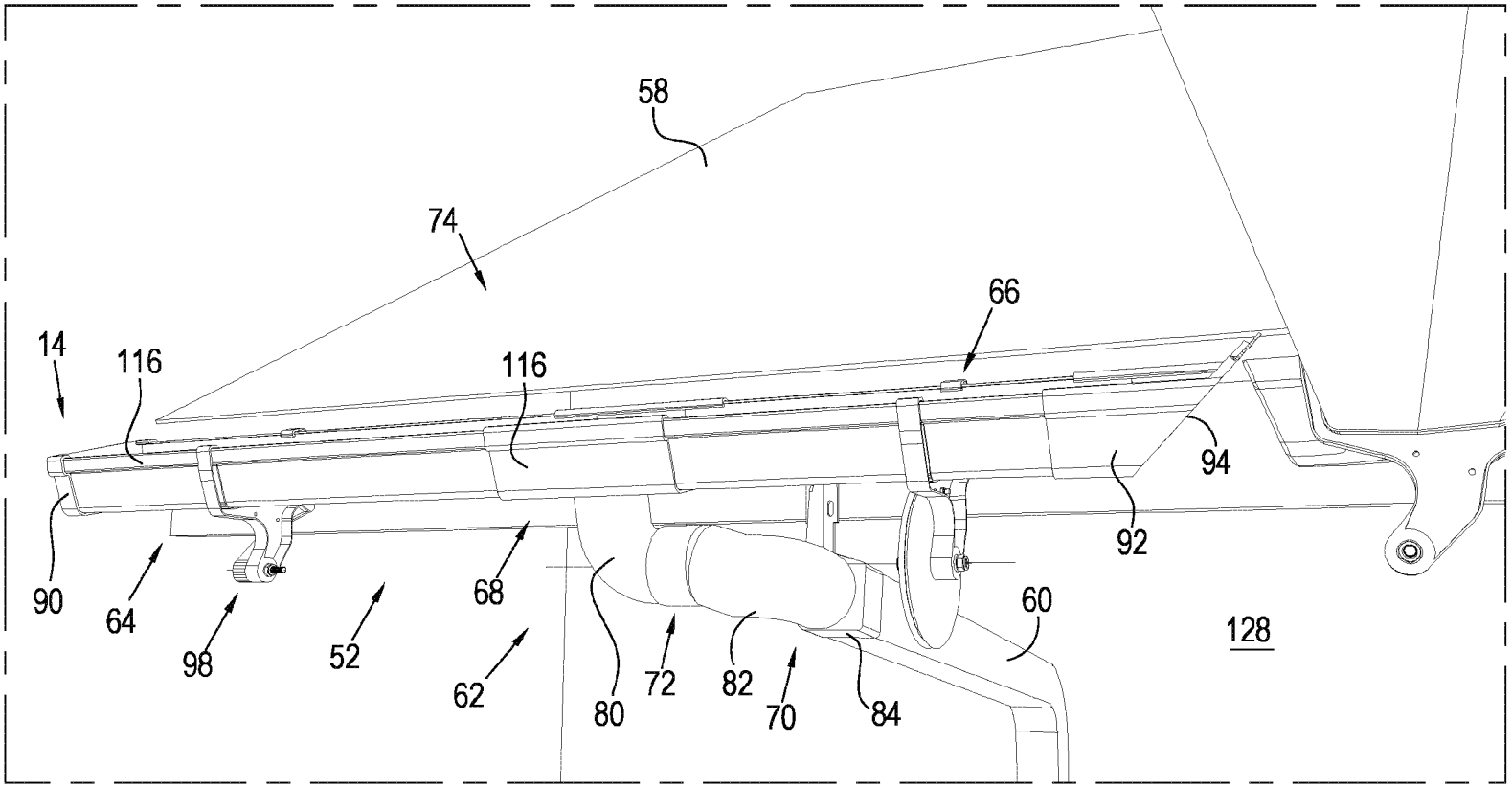
FIG. 16 shows a different three-dimensional view of the rain gutter assembly of FIG. 15.
Figure 17:
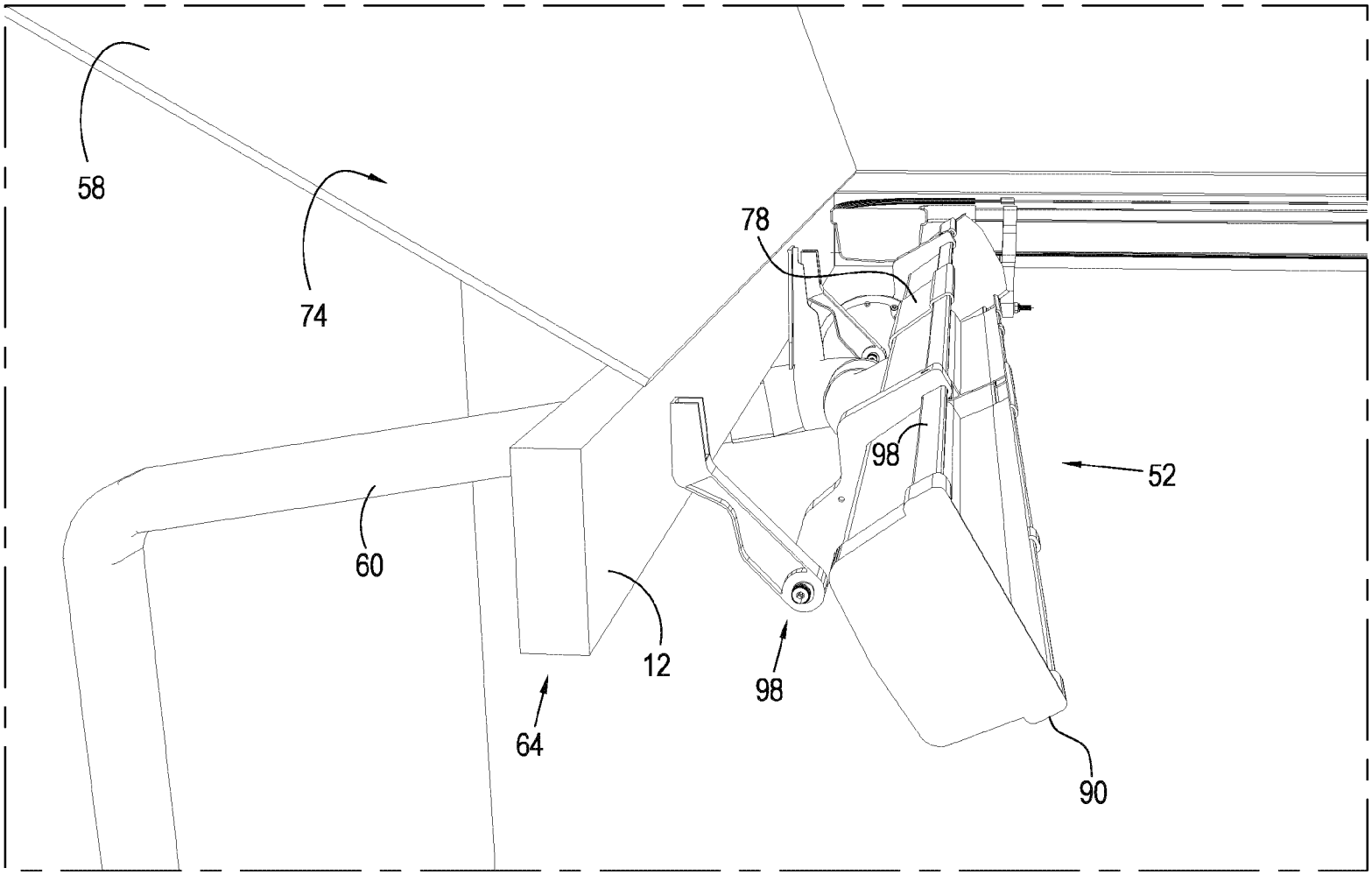
FIG. 17 shows a three-dimensional view similar to FIG. 15 with the rain gutter assembly displaced through 60°.
Figure 18:
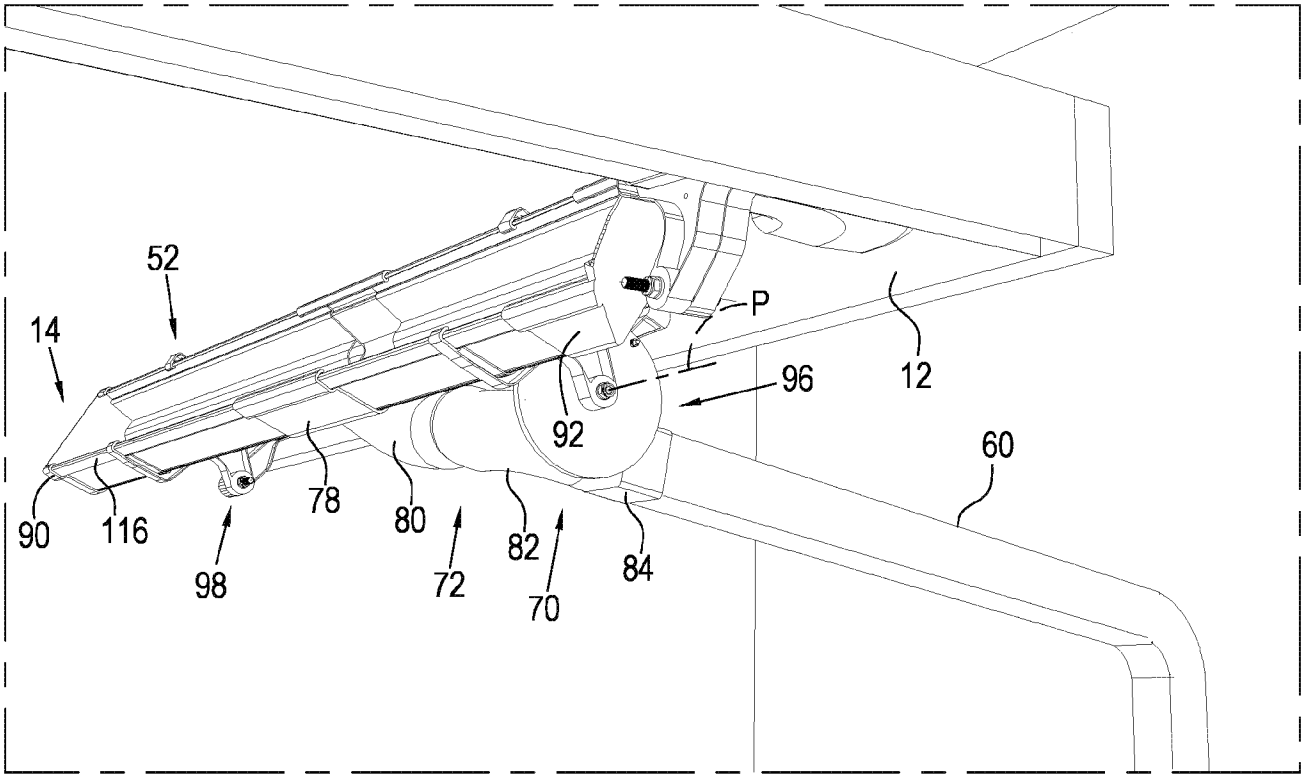
FIG. 18 shows another three-dimensional view of the rain gutter assembly of FIG. 17.
Figure 19:
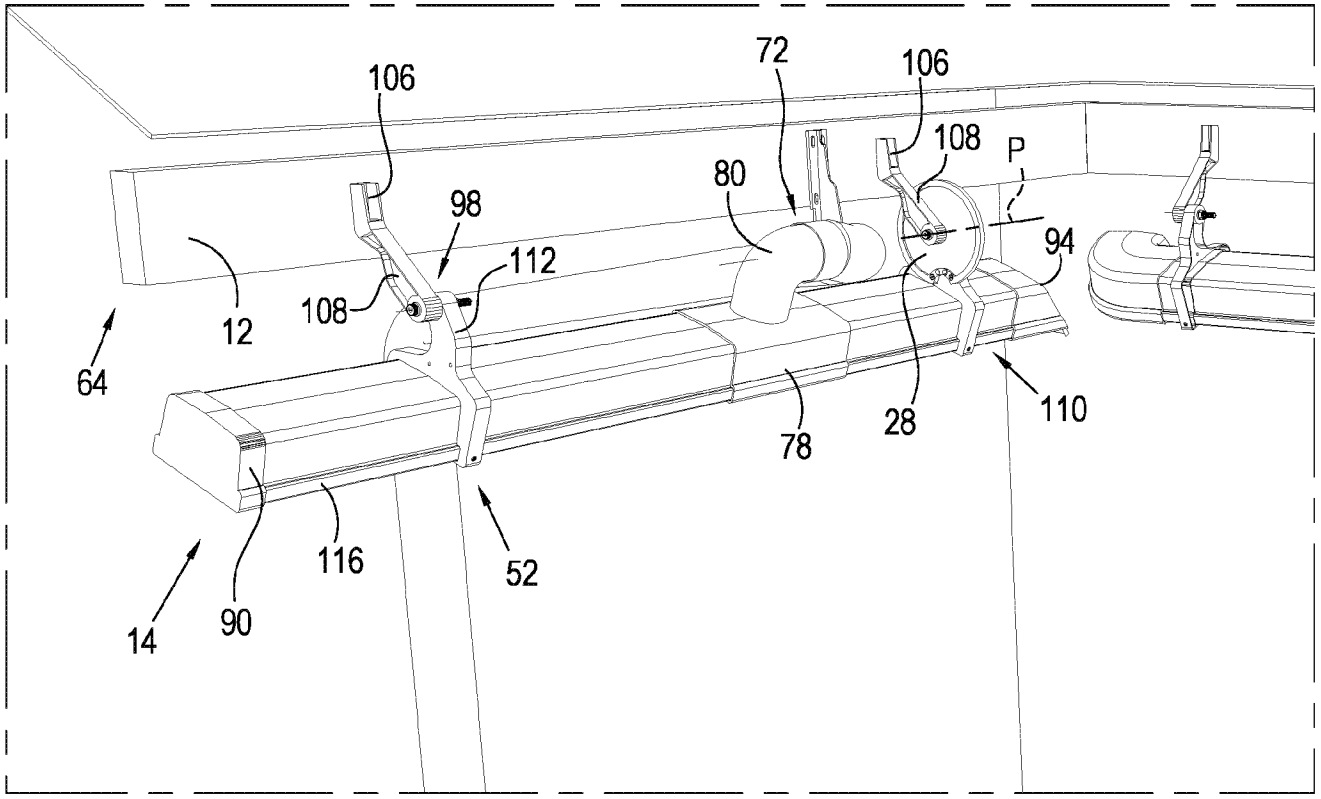
FIG. 19 shows a three-dimensional view, similar to FIG. 15, of the rain gutter assembly displaced to its inverted or discharge position.
Figure 20:
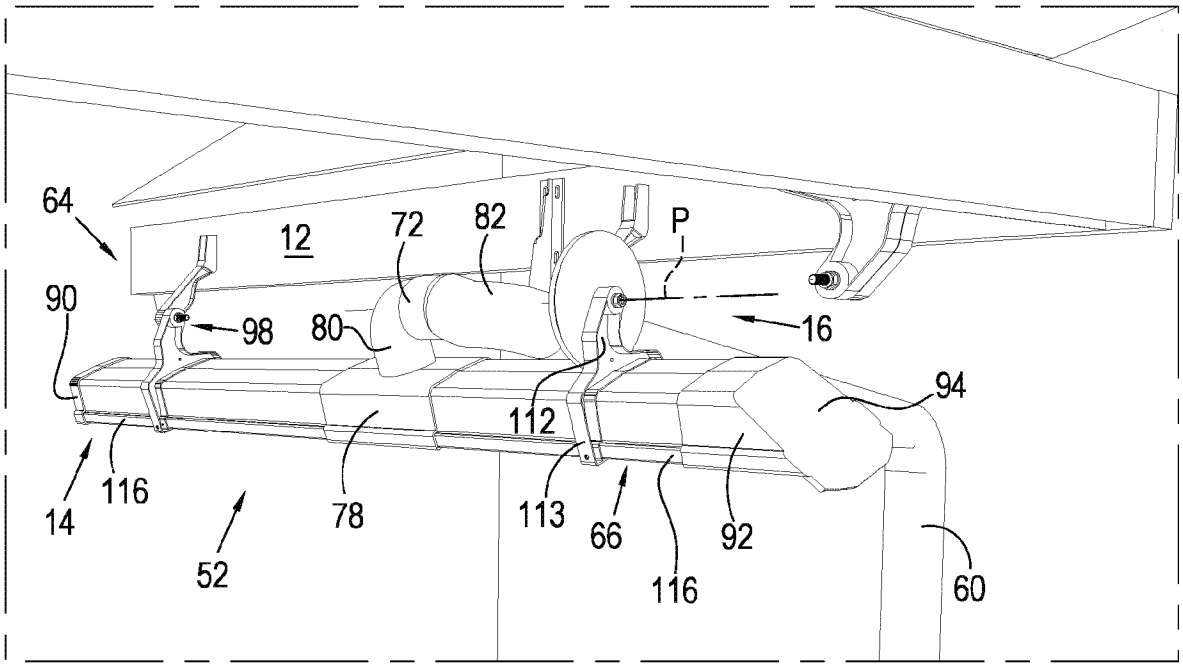
FIG. 20 shows another three-dimensional view of the rain gutter assembly of FIG. 19.
Figure 21:
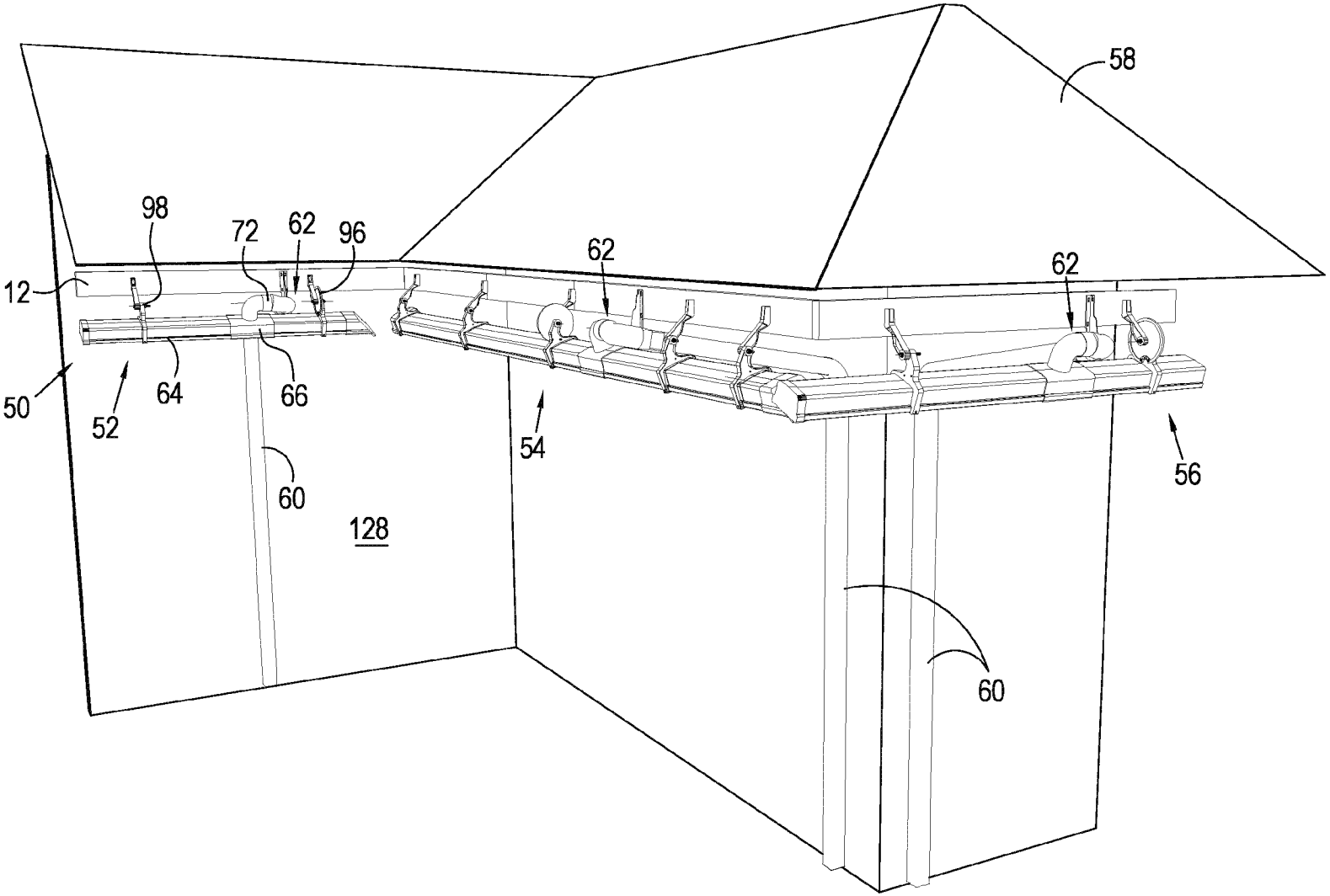
FIG. 21 shows a three-dimensional view similar to FIG. 9 with all of the rain gutter assemblies in their inverted or discharge positions.

Reference is now made to FIGS. 13 and 14 of the drawings, in which reference numeral 150 refers generally to part of another rain gutter arrangement in accordance with the invention. The rain gutter arrangement 150 is similar to the rain gutter arrangement 50 and, unless otherwise indicated, the same reference numerals used above are used to designate similar parts.

The main difference between the rain gutter arrangement 150 and the rain gutter arrangement 50 is that the rain gutter arrangement 150 includes a moving arrangement, generally indicated by reference numeral 152 which incorporates a pneumatic actuator 154.

The actuator 154 is contained within a hollow housing 156 which is mounted below the eaves of the roof 58. A pulley 158 is rotatably mounted to one end of the actuator 154 which is fixed within the housing. The rope 38 extends around the pulley 28 and the pulley 158 which serves as a return pulley. A piston rod 160 protrudes from a cylinder 162 of the actuator 154 and is displaceable between an extended and a retracted position. A rope engaging bracket 164 is connected to a free end of the piston rod 160 and secured to a length of the rope 38 by a grub screw 166. Hence, by extension or retraction of the piston rod 160, the gutter arrangement 150 can be displaced between its operative position and its discharge position.

It will be appreciated, that the moving arrangement 152 will require a supply of compressed air which is connected in flow communication with the actuator 154. In this regard, the Inventor envisages the use of a small compressor which can be operated as and when displacement of the gutter is required.

Figure 22:
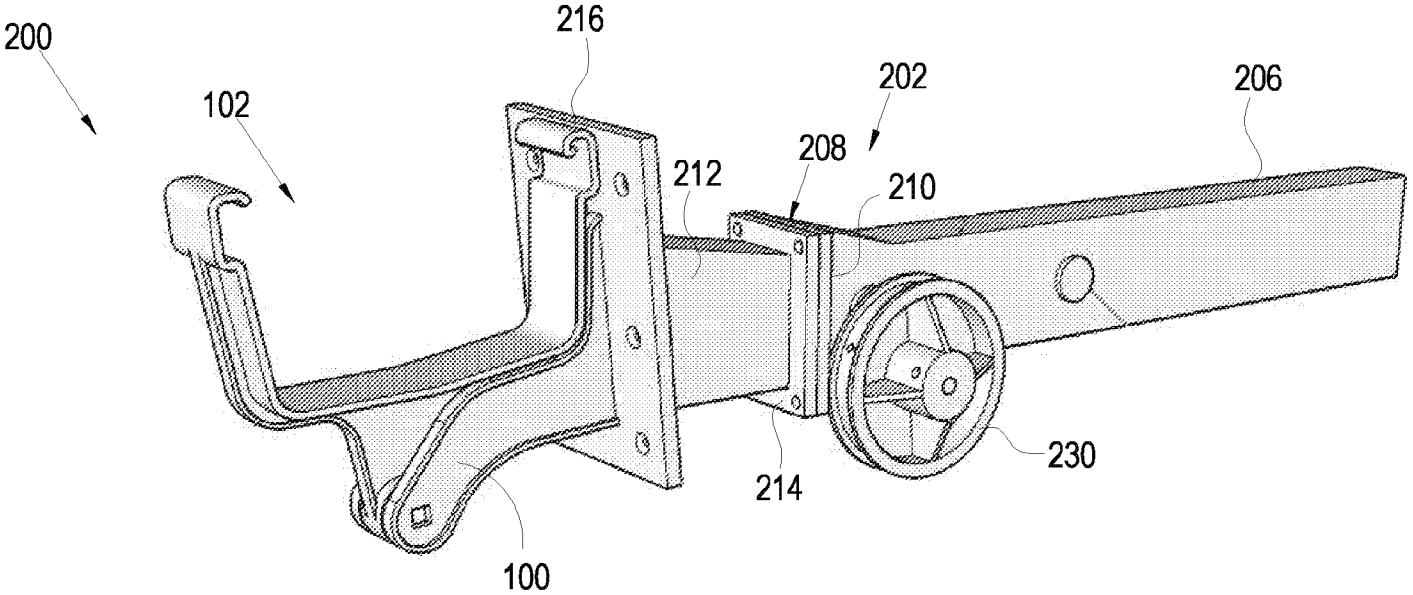
FIG. 22 shows a three-dimensional view of part of another rain gutter arrangement in accordance with the invention.
Figure 23:
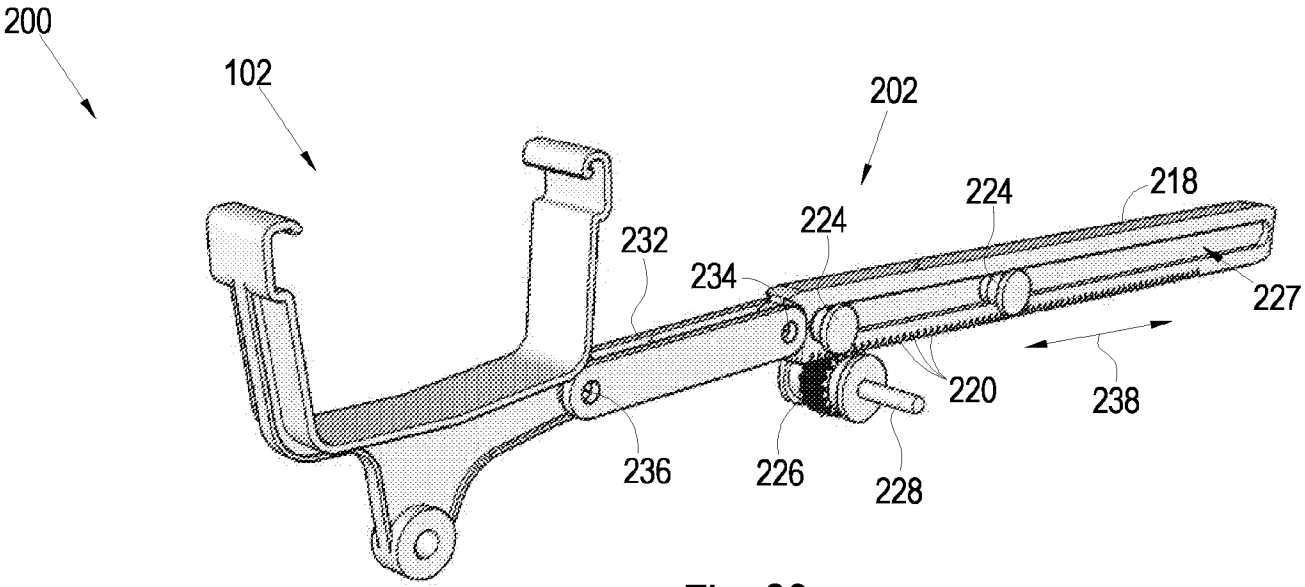
FIG. 23 shows a three-dimensional view of the internal components of the rain gutter arrangement of FIG. 22.
Figure 24:
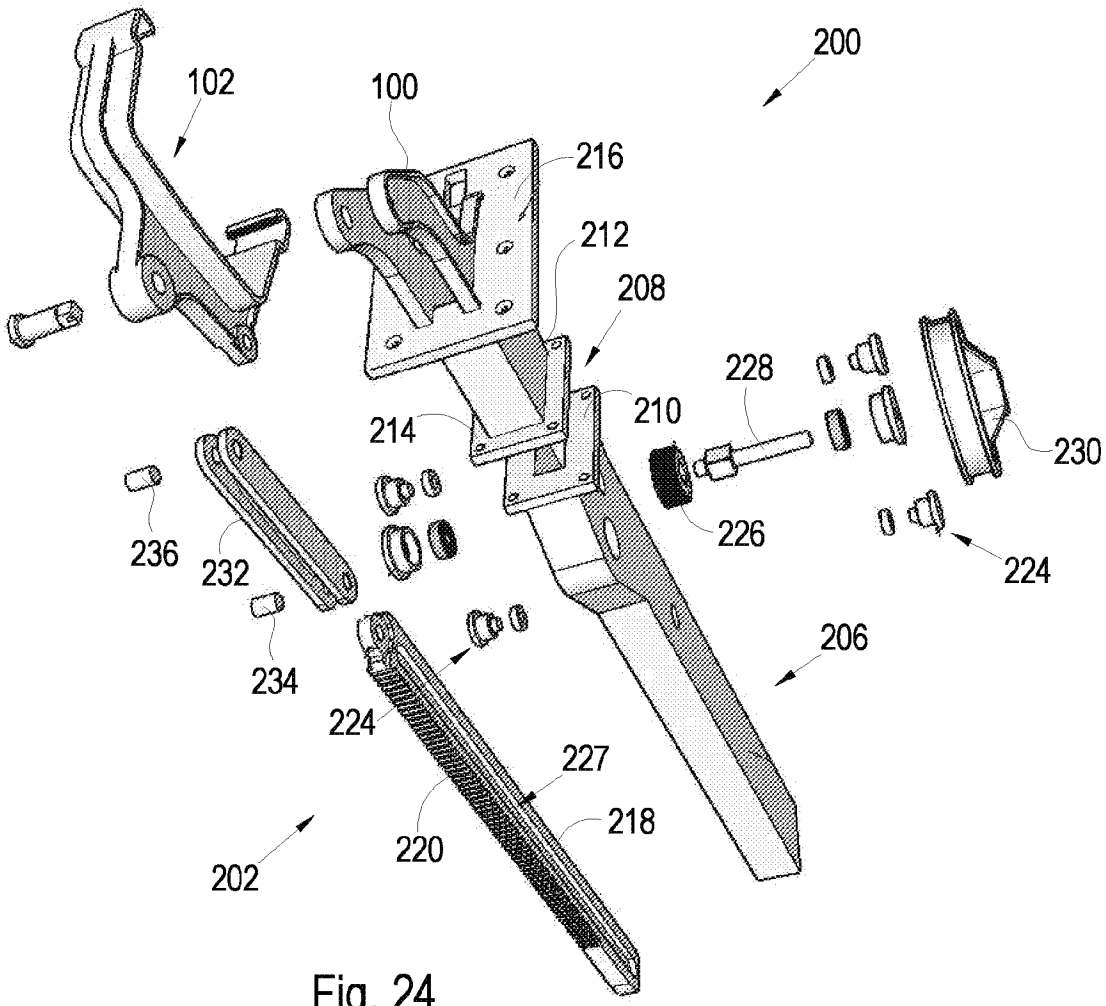
FIG. 24 shows a three-dimensional exploded view of the part of the rain gutter arrangement shown in FIG. 22.

Reference is now made to FIGS. 22 to 24 of the drawings in which reference numeral 200 refers generally to part of another rain gutter arrangement in accordance with the invention. The rain gutter arrangement 200 is similar to the rain gutter arrangement 150 and, unless otherwise indicated, the same reference numerals used above are used to designate similar parts.

The main differences between the rain gutter arrangement 200 and the rain gutter arrangements 50, 150, is that the rain gutter arrangement 200 incorporates a moving arrangement, generally indicated by reference numeral 202, which is described in more detail herebelow.

In this embodiment of the invention, the moving arrangement 202 includes an elongate hollow housing 206 having an open end 208 surrounded by flange 210. A tubular sleeve 212 is connected to the flange 210 by means of a flange 214 provided at one end of the sleeve 212. A flange 216 is provided at the other end of the sleeve 12. The sleeve 212 accordingly forms an extension of the housing 206.

An elongate rack 218 which is provided with gear teeth 220 along one side thereof is slidably mounted in the housing 206. In this regard, an elongate slot 227 is provided in the rack 218 and the rack is supported on two pairs of longitudinally spaced apart slide bearings 224 mounted within the housing, on both sides of the rack. A pinion 226 is rotatably mounted in the housing 206 and is in driving engagement with the gear teeth 220 of the rack 218. The pinion is mounted on a shaft 228 which protrudes from the housing 206. A drive pulley 230 is mounted on the protruding portion of the shaft 228. An elongate link rod 232 is pivotally connected at its one end by means of a pivot pin 234 to an end of the rack 218 and is pivotally connected at its other end by means of a pivot pin 236 to the second portion 102. The first portion 100 is fixed to the flange 216. Flange 216 is typically attached to the facia board 12, which will be slotted to accommodate the sleeve 212.

In use, by rotating the pulley 230 by means of a rope looped around the pulley 230, the rack 218 can be displaced in the direction of arrow 238 (FIG. 23). This displaces the link rod 232 in the direction of arrow 238 which in turn causes the second portion 102 to pivot about the pivot axis P thereby displacing the gutter from the rain gathering position to the inverted or discharge position described above. Displacement of the pulley 230 in the opposite direction, will cause retraction of the rack 218 and hence the link rod 232 to return the gutter to its rain gathering position.

The pulley 230 could be replaced by an electric, pneumatic or hydraulic motor or geared motor to rotate shaft 228.

Similarly, the rack 218, pinion 226, shaft 228 and pulley 230 could be replaced by an alternative linear drive mechanism such as a worm drive, pneumatic or hydraulic cylinder etc. Similarly, the pinion 226, shaft 228 and pulley 230 could be replaced by an alternative linear drive mechanism such as a worm drive, pneumatic or hydraulic cylinder etc. to drive the rack 218.

All of the above variations would facilitate easy automation or remote control, or integration with a smart home management system, as an alternative to the manual rope drive.

The geometry of the moving arrangement determines optimal torque when the gutter gravitational load is highest (including debris load) and allows a total rotation angle of the gutter exceeding 180°. Cantilever loading on the rack 218 assists with the reduction of drive torque required.

It will be appreciated that when the rope which is used to drive the pulley 230 is secured, the engagement of the gear teeth 220 of the rack 218 with those of the pinion 216 serve as a mechanical lock to retain the gutter in any desired position between the upright and inverted positions.

The Inventor believes that advantages of this embodiment include that it minimises the hinge pivot point below the gutter to allow for pivoting of the drain assembly. Further, the moving arrangement will be concealed under the roof eave. Further, the Inventor believes that the drive rope tension required to operate the arrangement will be substantially reduced.

Figure 25:
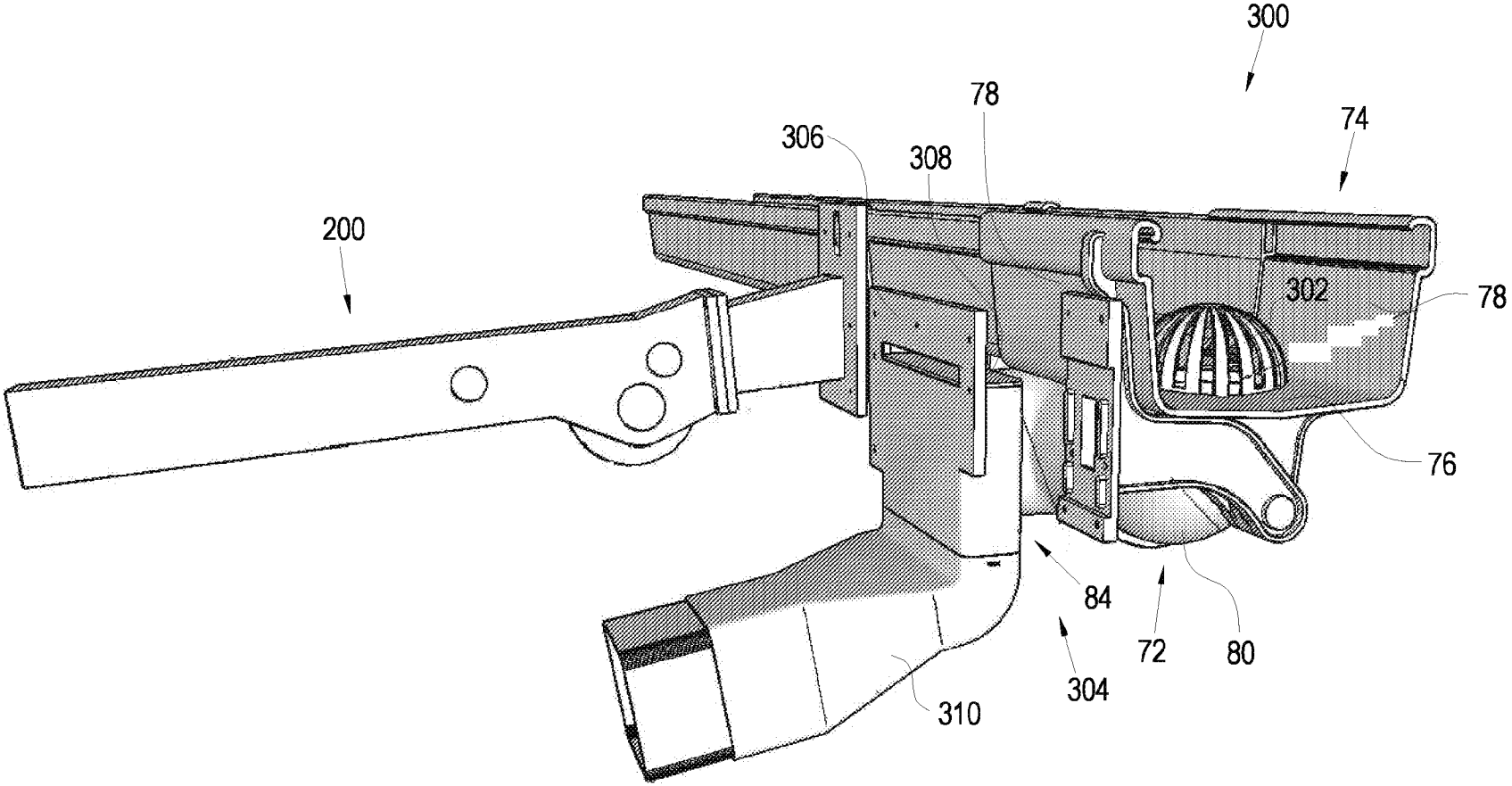
FIG. 25 shows a three-dimensional view of part of yet another rain gutter arrangement in accordance with the invention.
Figure 26:
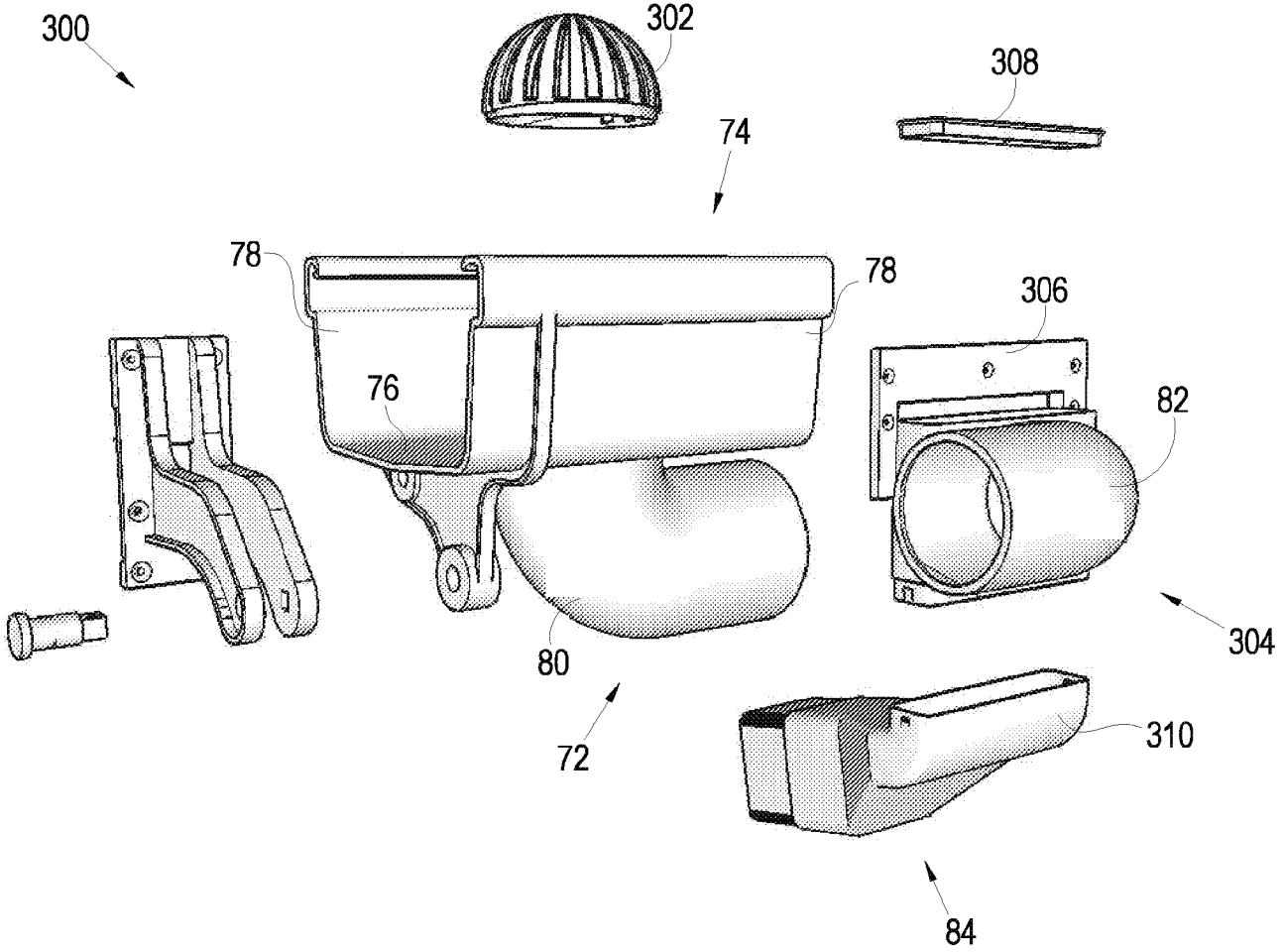
FIG. 26 shows a three-dimensional exploded view of a drain assembly which forms part of the rain gutter arrangement shown in FIG. 25.

Referring now to FIGS. 25 and 26 of the drawings, reference numeral 300 refers generally to part of another rain gutter arrangement in accordance with the invention and, unless otherwise indicated, the same reference numerals used above are used to designate similar parts. This embodiment is similar to the embodiment described with reference to FIG. 10 and, unless otherwise indicated, the same reference numerals used above are used to designate similar parts. In this embodiment, a drain strainer, 302 is mounted over the hole in the base 76 to prevent the ingress of foreign matter such as leaves and the like which could block the drainpipe.

Figure 31:
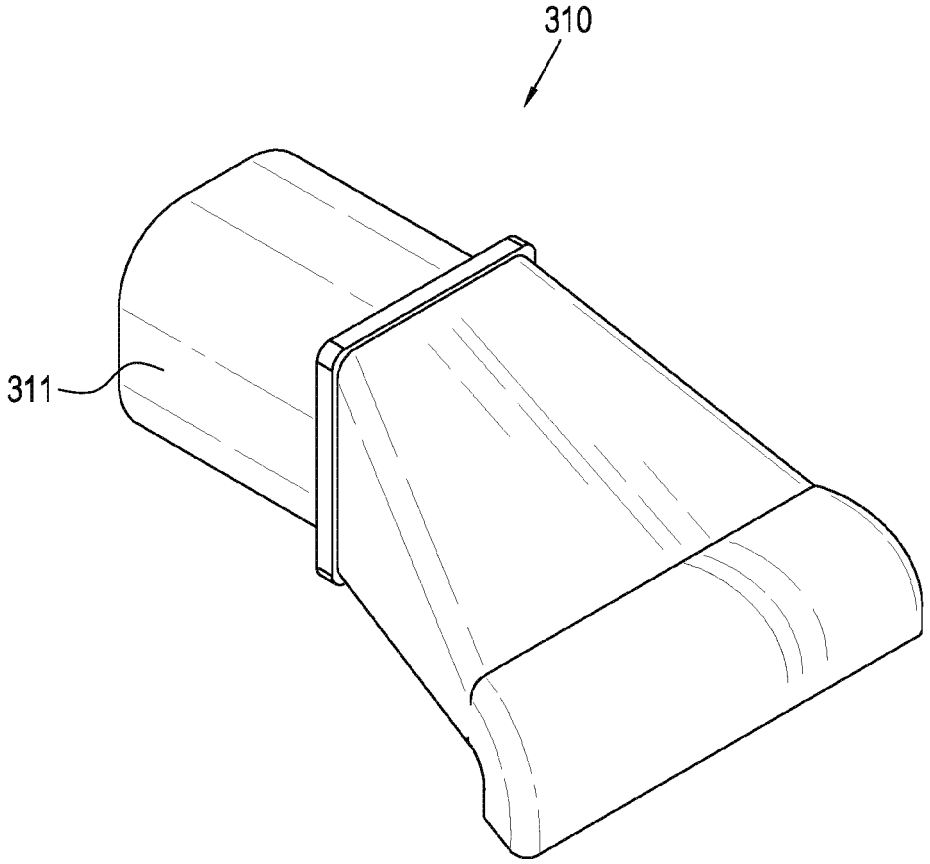
FIG. 31 shows a three-dimensional view of another manifold, similar to the manifold of the rain gutter arrangement of FIGS. 25 and 26.

In addition, the elbow 82 is disconnected via a connection box 304 to a flange 306 which in use is connectable to the facia board. The connecting box 306 has an open top which is closed by a cap 308. In addition, the connection box 304 has an open bottom which is connected by means of a manifold 310 to a down pipe. Referring also to FIG. 31 of the drawings, the manifold 310 has a male connection formation 311 which is receivable in an upper end of a down pipe. In this regard, the male connecting formation 311 can be dimensioned to conform to the shape of the down pipe. In the embodiment shown in FIG. 31 of the drawings, the male connecting formation 311 is generally square in transverse cross-section having rounded corners. This permits it to be used with both square and round down pipes.

Figure 27:
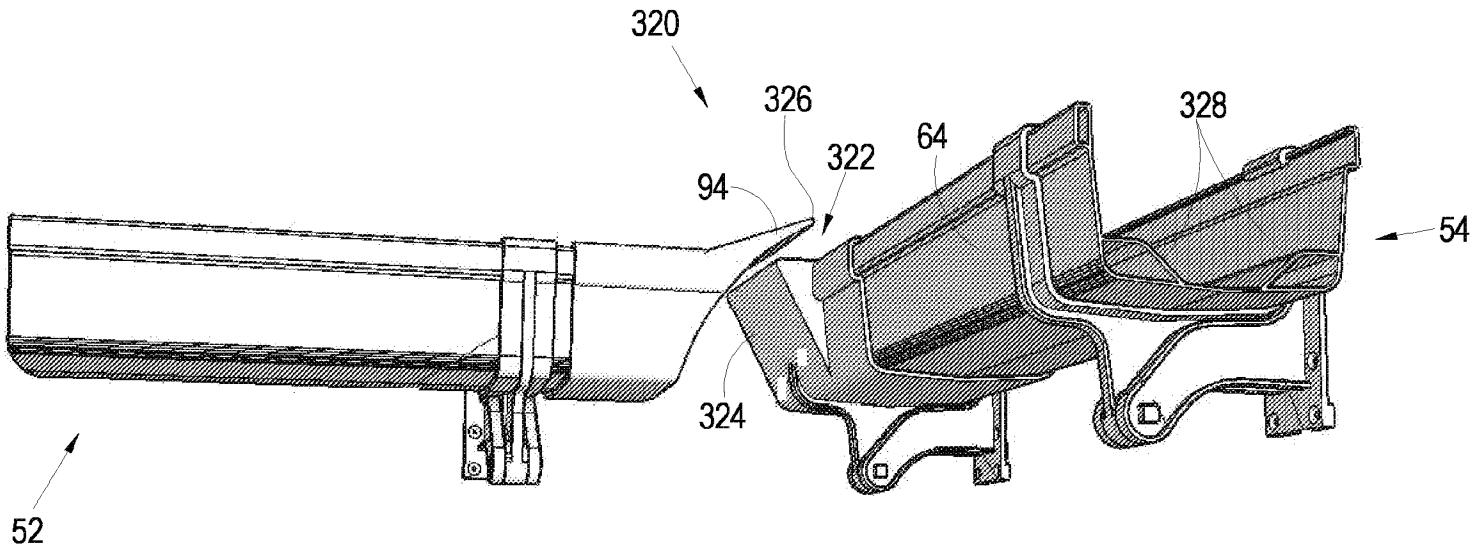
FIG. 27 shows a three-dimensional view of part of yet another rain gutter arrangement in accordance with the invention.

Reference is now made to FIG. 27 of the drawings in which reference numeral 320 refers generally to part of another rain gutter arrangement in accordance with the invention. In this embodiment of the invention, an end cap 322 has a protruding portion 324 which protrudes laterally beyond the side of the elongate section 64 of the gutter. In addition, the end face 94 is further extended to form a lip 326 which extends above the protruding portion 324 to inhibit the passage of precipitation or water run-off between the adjacent lengths of gutter.

Further, the lengths of gutter are typically formed by extruding a synthetic plastics material. Reinforcing webs 328 extend between the base and sidewalls of each length of gutter in order to improve the torsional rigidity thereof.

Figure 28:
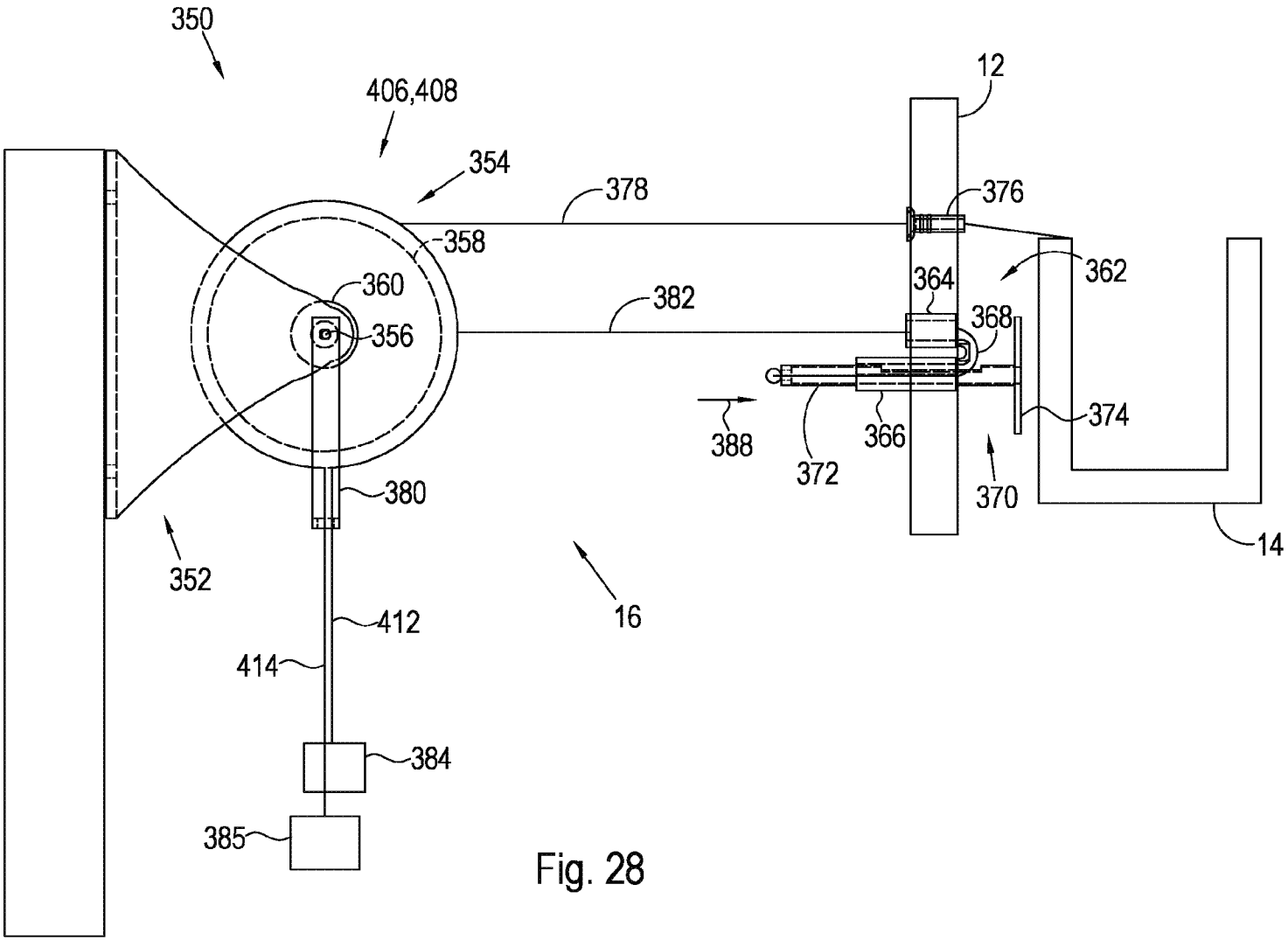
FIG. 28 shows a side view of part of still another rain gutter arrangement in accordance with the invention.
Figure 29:
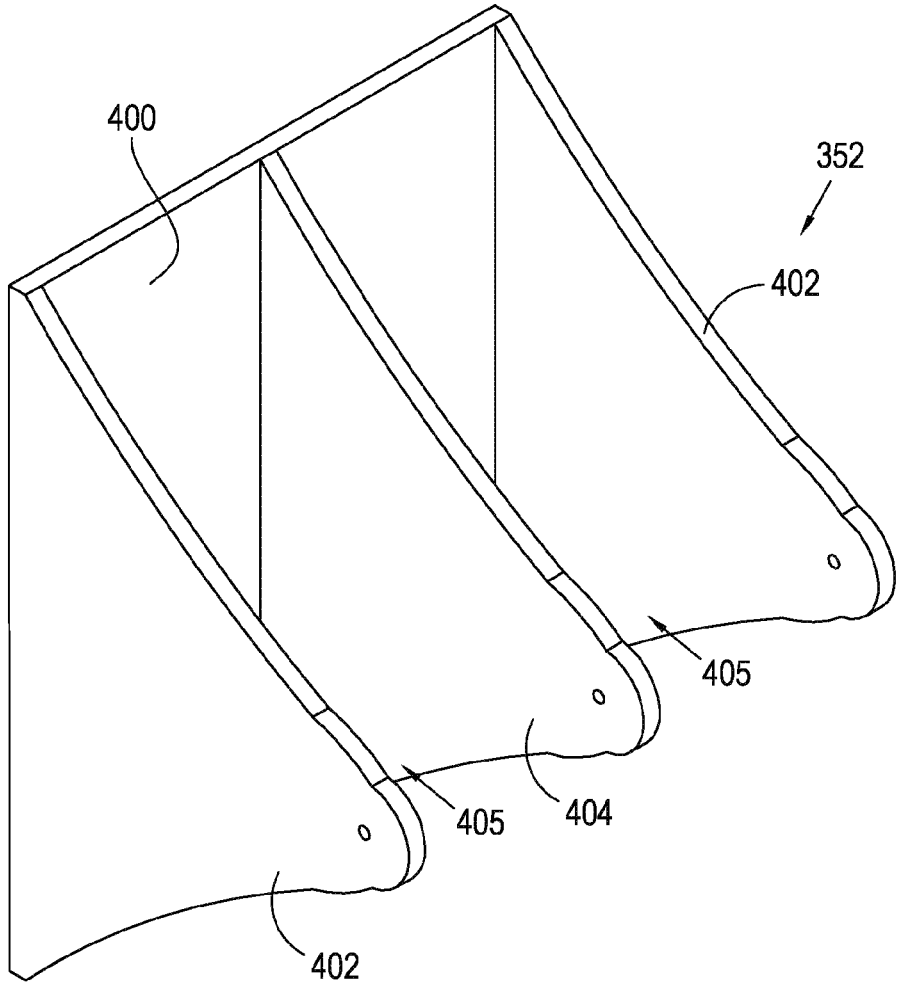
FIG. 29 shows a three-dimensional view of a pulley support bracket forming part of the arrangement of FIG. 28.
Figure 30:
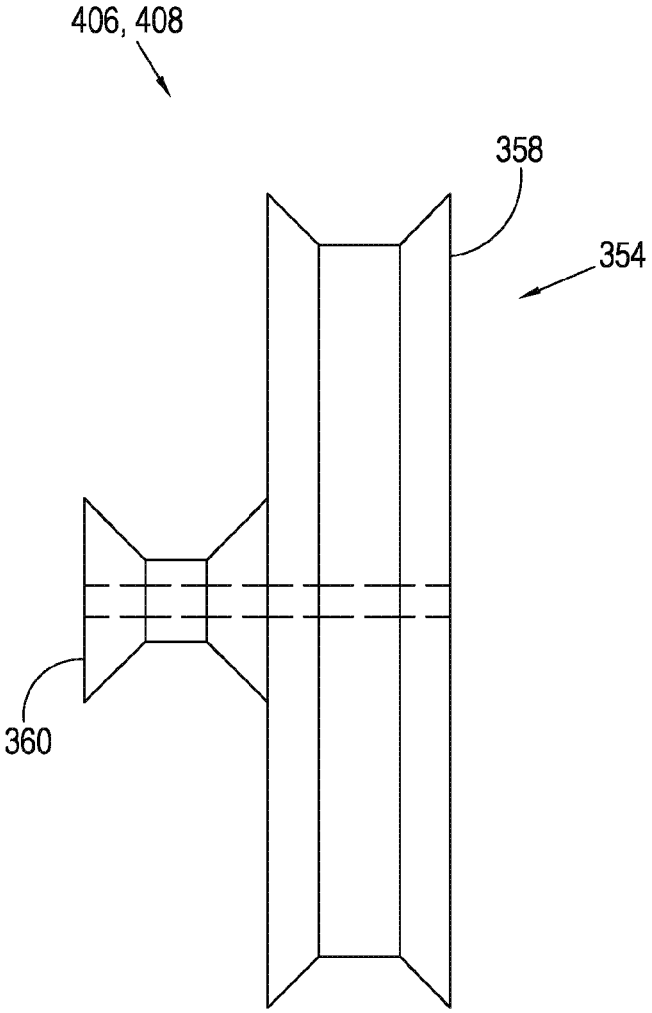
FIG. 30 shows a side view of a pulley arrangement forming part of the arrangement of FIG. 28.

Referring now to FIGS. 28 to 30 of the drawings, reference numeral 350 refers generally to part of still another rain gutter arrangement in accordance with the invention. Unless otherwise indicated, the same reference numerals used above are used to designate similar parts.

The main difference between the arrangement 350 and the arrangements described above relates to the moving arrangement 16 and the manner in which the gutter 14 is displaced between its operative and inverted positions. Accordingly, in the interests of clarity, the brackets supporting the gutter 14 have been omitted.

In this embodiment of the invention, the moving arrangement 16 includes a wall mounted bracket 352 on which a pulley arrangement, generally indicated by reference numeral 354 is mounted via a pivot pin 356. As can best be seen in FIG. 29 of the drawings, the bracket 352 includes a base 400. Two end panels 402 protrude from the base and a centrally disposed intermediate panel 404 protrudes from the base such that a channel-shaped recess 405 is defined between each end panel 402 and the intermediate panel 404. The pulley arrangement further includes two pulley sets 406, 408 which are mounted, respectively, for rotation within the channel-shaped recesses 405. Each pulley set 406, 408 is substantially identical and includes, secured together, a large pulley 358 and a small pulley 360. As mentioned above, the pulley sets 406, 408 are mounted via the pivot pin 356.

A push rod assembly 362 is mounted in a complementary hole in the facia board 12. The push rod assembly 362 includes a tubular upper sleeve 364 and a guide cylinder 366 which is parallel with the upper sleeve 364. A curved rope guide 368 which is semi-circular in shape extends between operatively outer ends of the upper sleeve 364 and the guide cylinder 366, i.e. their ends facing the gutter 14.

The moving arrangement 16 further includes a push arm, generally indicated by reference numeral 370 which includes an elongate stem 372 and a head 374 connected to one end of the stem 372. The stem 372 is positioned slidably within the guide cylinder 366 for longitudinal displacement relative thereto.

A second rope guide in the form of a sleeve 376 extends through the facia board 12 at a position above the rope guide 362. An elongate flexible element in the form of a pull rope 378 is connected at its one end to the gutter 14 and extends through the second sleeve 376 and around the small pulley 360 of the pulley set 406. In this regard, the pull rope 378 is wound around the small pulley 360 several times. A second rope 412 has one end secured to the large pulley 358 of the pulley set 406 and has several windings extending around the large pulley 358 from where it extends downwardly through the rope guide 380 and a counterweight 384 is attached to the free end thereof. It is important to note that the pull rope 378 and the second rope 412 are wrapped around their respective pulleys in opposite directions such that when the pulley set 406 is rotated in a direction which causes the pull rope 378 to unwind from the small pulley 360 the second rope 412 is wound onto the large pulley 358 and vice versa.

An elongate flexible element in the form of a push rope 382 is connected at its one end to the stem 372 from where it extends outwardly towards the gutter 14 and around the rope guide 368 and through the upper sleeve 364 from where it extends around the small pulley 360 of the pulley set 408. In the same manner as described above, the push rope 382 is wound around the small pulley 360 several times. Another elongate member in the form of a rope 414 is connected at its one end to the large pulley 358 of the pulley set 408. The rope 414 is wound around the large pulley several times and then extends downwardly therefrom through a guide 380 and a counterweight 385 is attached to the free end thereof. As, in the manner described above, the rope 382 and rope 414 are wound around the pulleys 360, 358, respectively in opposite directions such that when the pulley set 408 is rotated in a direction which causes the rope 382 to unwind from the pulley 360, the rope 414 is wound onto the pulley 358 and vice versa.

In use, in order to displace the gutter 14 from its operative or rain gathering position (shown in FIG. 28 of the drawings) to its pivoted or inverted discharge position, the free end of the rope 414 is pulled downwardly. This causes the pulley set 408 to rotate in a direction which causes the push rope 382 to be wound onto the small pulley 360. This, in turn, displaces the push arm 370 outwardly, i.e. in the direction of arrow 388, such that the head 374 abuts against the side of the gutter 14 and displaces it away from its operative position towards its discharge position. It will be appreciated, that as the gutter moves in this direction, it will pull the pull rope 378 outwardly through the second rope guide 376 which causes the pull rope 378 to unwind from the pulley 368 and winds the rope 412 onto the pulley 358. Once the centre of gravity of the gutter passes the pivot point of the support brackets, it will be urged, under the influence of gravity, towards its fully displaced position. In this regard, the counterweight 384 attached to the rope 412 will serve as a damper to avoid the gutter moving too quickly.

When it is desired to return the gutter to its operative position, the free end of the rope 412, i.e. the end to which counterweight 384 is connected is pulled downwardly which causes the pull rope 378 to be wound onto the pulley 360 which in turn displaces the gutter back towards its operative position. In so doing, the gutter abuts against the head 374 of the push arm 370, thereby urging the push arm in a direction opposite to the direction of arrow 388. This in turn causes the rope 382 to unwind from the small pulley 360 and the rope 414 to be wound onto the large pulley 358.

It will be appreciated that the bracket 352 can be mounted on a wall, the facia or a roof or roof support structure. In the embodiment shown, the pulley sets 406, 408 are substantially identical, however, this need not be the case. In this embodiment, each small pulley 360 has a diameter of 15 mm and the large pulley 358 has a diameter of 70 mm. this effectively creates a geared effect which facilitates operation of the rain gutter arrangement 350. This is further facilitated by the provision of the counterweights 384, 385.

The Inventor believes that this arrangement will permit installation of the moving arrangement 16 even in situations where there is relatively little space between the facia board 12 and the adjacent wall.

The Inventor believes that the gutter assembly described herein facilitates cleaning and servicing of gutters. A gutter may be moved from the rain gathering position to the inverted position and cleaned without the need to climb onto a roof or use a ladder, e.g. using a hose or other water spray. This may make such tasks simpler and may reduce the risk of injury to individuals responsible for cleaning gutters. Furthermore, accumulated matter may be discharged from the gutter when in the inverted position through the operation of gravity. The gutter assembly can thus be used to remove obstructions in a gutter in a relatively easy manner, thereby reducing the risk of damage to the gutter and/or the gutter becoming ineffective for its intended purpose.

In particular, the Inventor believes that features of the invention include that the tilting sections allow the easy and safe removal of debris and foreign bodies in the gutter, by gravity alone, and if necessary assisted by water or air spraying or even brushing when inverted.

By tilting the gutter periodically, residual water which is standing in the gutter after precipitation can be discharged therefrom which helps to prevent smells from decomposing material or the breeding of mosquitos and other aqueous creatures. When forming part of a rainwater collection system, this practice will ensure that the water collected during a subsequent precipitation is free from such decomposing materials or living organisms.

The configuration of the brackets 96, 98 is such that, when the gutter arrangement is in its operative position, the centre of gravity is positioned inwardly of the pivot axis so as to retain the gutter assembly in its operative position under the influence of gravity. In addition, the brackets 96, 98 are configured that when displacing the gutter arrangement from its operative position to its discharge position, the gutter can clear the edge of the roof without needing to be positioned far below the roof edge. In addition, the configuration of the brackets permits the gutter arrangement to be displaced between its operative position and its discharge position with the application of relatively little torque to the pulley 28 or pulley 230, or the pulley sets 406, 408.

By tilting the gutter to its inverted or discharge position during the dry season, the collection of dry debris that could pose a fire threat during times of higher fire danger is substantially reduced.

Further, by displacing the gutter to its inverted or discharge position during winter in cold climates, where snow and ice could collect in the gutter, it avoids the gutter acting as a backstop to trap snow on the roof, and prevent ice build-up inside the gutter.

The invention claimed is:

1. A rain gutter assembly including a gutter which is generally channel-shaped in transverse cross-section and which has a substantially open top, and a moving arrangement, wherein the moving arrangement is attached or attachable to the gutter and is configured to move at least part of the gutter, about a pivot axis, between an operative or rain gathering position, in which the top of the gutter faces operatively upwardly, and an inverted or discharge position, in which the gutter is tilted such that the top of the gutter operatively faces at least partially downwardly to permit accumulated matter to be discharged from the gutter, the rain gutter assembly further including a drain assembly including a first part in which an end portion of the gutter is received such that the gutter and the first part are connected in flow communication, a second part which is connected or connectable to a downpipe and a coupling whereby the first and second parts are pivotably connected to one another for pivotal displacement relative to one another when the gutter is displaced between its operative position and its discharge position, wherein the first and second parts of the drain assembly are pivotably displaceable about the pivot axis.

2. A rain gutter assembly as claimed in claim 1, which includes at least one mounting element by which the gutter and the moving arrangement are mounted or mountable to a building or building element.

3. A rain gutter assembly as claimed in claim 2, in which the at least one mounting element is in the form of a mounting bracket having a first portion which is mounted or mountable to a building or building element, such as a facia board or a rafter, and a second portion which is drivingly connected or connectable to the moving arrangement.

4. A rain gutter assembly as claimed in claim 3, which includes a plurality of mounting brackets which are spaced apart along the length of the gutter.

5. A rain gutter assembly as claimed in claim 3, in which the moving arrangement includes a pulley and a primary tilt bracket, wherein the pulley is rotatable about the pivot axis.

6. A rain gutter assembly as claimed in claim 5, in which the pivot axis extends generally parallel to the length of the gutter.

7. A rain gutter assembly as claimed in claim 5, in which the primary tilt bracket includes a first portion which is pivotally attached or attachable to one of the at least one mounting elements and a second portion which is fixedly attached or attachable to the gutter.

8. A rain gutter assembly as claimed in claim 7, in which the primary tilt bracket is fixedly secured to the pulley such that angular displacement of the pulley causes the primary tilt bracket and the gutter to pivot about the pivot axis, wherein the second portion is configured clip-lockingly to engage with the gutter.

9. A rain gutter assembly as claimed in claim 5, in which the moving arrangement further includes one or more secondary tilt brackets which are spaced longitudinally along the length of the gutter from the primary tilt bracket.

10. A rain gutter assembly as claimed in claim 9, in which each of the one or more secondary tilt brackets has a first portion which is pivotally attached or attachable to a respective one of the at least one mounting elements and a second portion which is fixedly attached or attachable to the gutter, the rain gutter assembly including a drive rod arranged to connect the primary tilt bracket to the one or more secondary tilt brackets thereby to avoid excessive twisting of the gutter.

11. A rain gutter assembly as claimed in claim 5, in which the pulley is operated by an elongate flexible element.

12. A rain gutter assembly as claimed in claim 5, in which the pulley is driven by a prime mover.

13. A rain gutter assembly as claimed in claim 3, in which the moving arrangement includes an elongate gear rack which is drivingly connected to the second portion of the mounting bracket and a pinion which is drivingly connected to the gear rack for longitudinal displacement of the gear rack and displacement of the second portion between the rain gathering position and the inverted or discharge position.

14. A rain gutter arrangement which includes a plurality of rain gutter assemblies as claimed in claim 1, which are independently movable between their rain gathering and inverted positions and which are mounted to a building or building element in an end-to-end manner, such that end regions of adjacent gutters or the rain gutter assemblies overlap.

15. A rain gutter accessory which includes a moving arrangement for moving a gutter which forms part of a rain gutter assembly as claimed in claim 1, in which the moving arrangement is attached or attachable to the gutter having a substantially open top, wherein the moving arrangement is configured to move at least part of the gutter between an operative or rain gathering position, in which the top of the gutter faces operatively upwardly and an inverted or discharge position in which the gutter is tilted such the gutter operatively faces at least partially downwardly.

16. A rain gutter accessory as claimed in claim 15, which includes at least one mounting element whereby the gutter and the moving arrangement are mounted or mountable to a building.

17. A drain assembly for a drain gutter which includes a gutter which is displaceable between an operative position and a discharge position, the drain assembly including a first part which is configured to receive an end portion of at least one gutter therein and which is connected or connectable in flow communication with the gutter, a second part which is connected or connectable to a downpipe and a coupling whereby the first and second parts are pivotably connected to one another for pivotal displacement relative to one another when the gutter is displaced between its operative position and its discharge position, the first part including a first elbow and the second part including a second elbow, wherein the first and second elbows are rotationally interconnected to form the coupling.

18. A drain assembly as claimed in claim 17, in which the first part is generally channel-shaped such that end portions of adjacent gutters are receivable therein.

* * * * *